US006931226B2

(12) United States Patent
Chadani et al.

(10) Patent No.: US 6,931,226 B2
(45) Date of Patent: Aug. 16, 2005

(54) PROCESS CARTRIDGE REMANUFACTURING METHOD

(75) Inventors: Kazuo Chadani, Shizuoka-ken (JP); Hiroomi Matsuzaki, Mishima (JP); Shigeo Miyabe, Numazu (JP); Akira Suzuki, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/128,294

(22) Filed: Apr. 24, 2002

(65) Prior Publication Data

US 2002/0159787 A1 Oct. 31, 2002

(30) Foreign Application Priority Data

Apr. 27, 2001 (JP) ..... 2001/132705

(51) Int. Cl.[7] ..... G03G 15/00
(52) U.S. Cl. ..... 399/109
(58) Field of Search ..... 399/109, 113, 399/111, 107, 110

(56) References Cited

U.S. PATENT DOCUMENTS

| | | | | |
|---|---|---|---|---|
| 5,331,373 | A | 7/1994 | Nomura et al. | 355/200 |
| 5,452,056 | A | 9/1995 | Nomura et al. | 355/200 |
| 5,463,446 | A | 10/1995 | Watanabe et al. | 355/200 |
| 5,585,889 | A | 12/1996 | Shishido et al. | 355/200 |
| 5,640,650 | A | 6/1997 | Watanabe et al. | 399/117 |
| 5,839,028 | A | 11/1998 | Nomura et al. | 399/109 |
| 5,873,012 | A | 2/1999 | Miyabe et al. | 399/90 |
| 5,878,309 | A | 3/1999 | Nomura et al. | 399/111 |
| 5,878,310 | A | 3/1999 | Noda et al. | 399/117 |
| 5,926,666 | A | 7/1999 | Miura et al. | 399/25 |
| 5,943,529 | A | 8/1999 | Miyabe et al. | 399/111 |
| 5,946,531 | A | 8/1999 | Miura et al. | 399/111 |
| 5,950,047 | A | 9/1999 | Miyabe et al. | 399/111 |
| 5,966,567 | A | 10/1999 | Matsuzaki et al. | 399/111 |
| 6,011,941 | A | 1/2000 | Takashima et al. | 399/111 |
| 6,029,031 | A | 2/2000 | Yokomori et al. | 399/109 |
| 6,072,968 | A | 6/2000 | Nomura et al. | 399/113 |
| 6,097,906 | A | 8/2000 | Matsuzaki et al. | 399/90 |
| 6,128,452 | A | 10/2000 | Miyabe et al. | 399/90 |
| 6,144,815 | A | 11/2000 | Chadani et al. | 399/27 |

(Continued)

FOREIGN PATENT DOCUMENTS

| | | |
|---|---|---|
| EP | 0 683 439 | 11/1995 |
| EP | 1 054 307 | 11/2000 |
| JP | 7-12108 | 1/1995 |
| JP | 7-20762 | 1/1995 |
| JP | 9-62167 | 3/1997 |
| JP | 2001-34143 | 2/2001 |

OTHER PUBLICATIONS

Computer translation of JP07–020762A.*

*Primary Examiner*—Quana Grainger
(74) *Attorney, Agent, or Firm*—Fitzpatrick, Cella, Harper & Scinto

(57) ABSTRACT

A remanufacturing method for a process cartridge includes (a) removing the second end cover at the other longitudinal ends of the drum frame, the developing frame and the developer frame; (b) removing a drum shaft rotatably supporting the drum; (c) separating the drum and the developing roller from each other; (d) moving the drum outwardly from the process cartridge, so that the drum is inclined, and then removing the drum from the drum frame; (e) inserting one end of a new drum such that a driving force receiving portion is exposed outside the drum frame, and inserting the drum shaft from outside of the drum frame; (f) opening a filling port provided in the developer accommodating portion, refilling the developer and then closing the filling port; and (g) fixedly mounting a second end cover to the other longitudinal ends of the drum frame, the developing frame and the developer frame.

26 Claims, 27 Drawing Sheets

U.S. PATENT DOCUMENTS 6,154,623 A 11/2000 Suzuki et al. ..... 399/111
6,167,219 A 12/2000 Miyamoto et al. ..... 399/90
6,173,140 B1 1/2001 Suzuki et al. ..... 399/113
6,173,145 B1 1/2001 Chadani et al. ..... 399/265
6,178,302 B1 1/2001 Nagashima et al. ..... 399/106
6,205,305 B1 3/2001 Suzuki et al. ..... 399/106
6,215,969 B1 4/2001 Nomura et al. ..... 399/111
6,219,504 B1 4/2001 Matsuzaki et al. ..... 399/92
6,223,010 B1 * 4/2001 Araki ..... 399/109
6,246,853 B1 6/2001 Suzuki et al. ..... 399/262
6,282,389 B1 8/2001 Matsuzaki et al. ..... 399/111
6,282,390 B1 8/2001 Miyabe et al. ..... 399/111
6,301,457 B1 10/2001 Chadani et al. ..... 391/167
6,317,572 B1 11/2001 Miyabe et al. ..... 399/111
6,336,017 B1 1/2002 Miyamoto et al. ..... 399/116
6,351,620 B1 2/2002 Miyabe et al. ..... 399/111
6,542,706 B2 4/2003 Toba et al. ..... 399/111

* cited by examiner

PROCESS CARTRIDGE REMANUFACTURING METHOD

FIELD OF THE INVENTION AND RELATED ART

The present invention relates to a process cartridge remanufacturing method. Here, a process cartridge is a cartridge in which a minimum of a developing means and an electrophotographic photoconductive member are integrally disposed, and which is removable mountable in the main assembly of an electrophotographic image forming apparatus.

An electrophotographic image forming apparatus includes an electrophotographic copying machine, an electrophotographic printer(for example, an LED printer, a laser beam printer, and the like), an electrophotographic facsimile, an electrophotographic word processor, and the like.

In an electrophotographic image forming apparatus, a process cartridge system has long been employed. According to this system, an electrophotographic photoconductive member, and a single or a plurality of processing means, which act on the electrophotographic photoconductive member, are integrated into the form of a cartridge removably mountable in the main assembly of the image forming apparatus. This system enables a user him/her self to maintain the apparatus without relying on a service person, immensely improving the operability of the apparatus. Thus, the process cartridge system has been widely used in the field of an image forming apparatus.

A process cartridge such as the one described above forms an image on a recording medium with the use of developer (toner) contained therein. Therefore, the amount of the developer therein gradually decreases with image formation, eventually to a level below which it fails to form an image satisfactory in quality to the user who purchased the process cartridge. At this point, the process cartridge loses its commercial value.

Thus, it has long been desired to realize a simple method for remanufacturing a process cartridge so that a process cartridge which has lost its commercial value due to the depletion of the developer therein can be marketed again.

SUMMARY OF THE INVENTION

The primary object of the present invention is to provide a simple method for remanufacturing a process cartridge.

Another object of the present invention is to provide a method for remanufacturing a process cartridge, the commercial value of which has been lost due to the consumption of the developer therein to a level below which the process cartridge fails to form an image satisfactory in quality to a user who has purchased the process cartridge.

According to an aspect of the present invention, there is provided a remanufacturing method for a process cartridge detachably mountable to a main assembly of an electrophotographic image forming apparatus, wherein the process cartridge includes a drum frame supporting an electrophotographic photosensitive drum and having at one end a driving force receiving portion for receiving a driving force for rotating the electrophotographic photosensitive drum from the main assembly of the electrophotographic image forming apparatus when the process cartridge is mounted to the main assembly of the electrophotographic image forming apparatus; a developing frame supporting a developing roller for developing an electrostatic latent image formed on the electrophotographic photosensitive drum, a developer frame having a developer accommodating portion for accommodating a developer to be used to develop the electrostatic latent image by the developing roller; a first end cover fixed to one longitudinal end of the drum frame, the developing frame and the developer frame and fixed to the one ends of the drum frame and the developer frame; and a second end cover fixed to the other longitudinal ends of the drum frame, the developing frame and the developer frame and fixed to the other ends of the drum frame and the developer frame, the second end cover including a grip for facilitating mounting and demounting of the process cartridge relative to the main assembly of the electrophotographic image forming apparatus, the method comprising:

(a) an end cover removing step of cutting a fixing portion between the second end cover and the drum frame and cutting a fixing portion between the second end cover and the developer frame, and removing the second end cover at the other longitudinal ends of the drum frame, the developing frame and the developer frame;

(b) a drum shaft removing step of removing, at the other ends, a drum shaft rotatably supporting the electrophotographic photosensitive drum at the other ends;

(c) a roller separating step of applying forced to the drum frame, the developing frame and the developer frame in directions crossing with a longitudinal direction of electrophotographic photosensitive drum so as to separate the electrophotographic photosensitive drum and the developing roller from each other;

(d) a drum removing step of moving the electrophotographic photosensitive drum outwardly from the process cartridge at the other end of the electrophotographic photosensitive drum, while keeping the forces applied to the drum frame, the developing frame and the developer frame, so that electrophotographic photosensitive drum is inclined, and then removing the electrophotographic photosensitive drum from the drum frame;

(e) a drum mounting step of inserting one end of a new electrophotographic photosensitive drum having at one end a driving force receiving portion for receiving a driving force for rotating the electrophotographic photosensitive drum from the main assembly of the electrophotographic image forming apparatus when the process cartridge is mounted to the main assembly of the electrophotographic image forming apparatus, such that a driving force receiving portion is exposed outside the drum frame, and inserting the drum shaft at the other end from outside of the drum frame, thus mounting a new drum electrophotographic photosensitive drum to the drum frame;

(f) a developer refilling step of opening a filling port provided in the developer accommodating portion, refilling the developer and then closing the filling port; and (g) an end cover mounting step of fixedly mounting a second end cover to the other longitudinal ends of the drum frame, the developing frame and the developer frame.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to FIGS. 1–9. In the following embodiments, the lengthwise direction means a direction which is perpendicular to the recording medium conveyance direction, and is parallel to the surface of the recording medium being conveyed.

Embodiment 1

Description of Process Cartridge and Image Forming Apparatus Main Assembly

Figure 1:
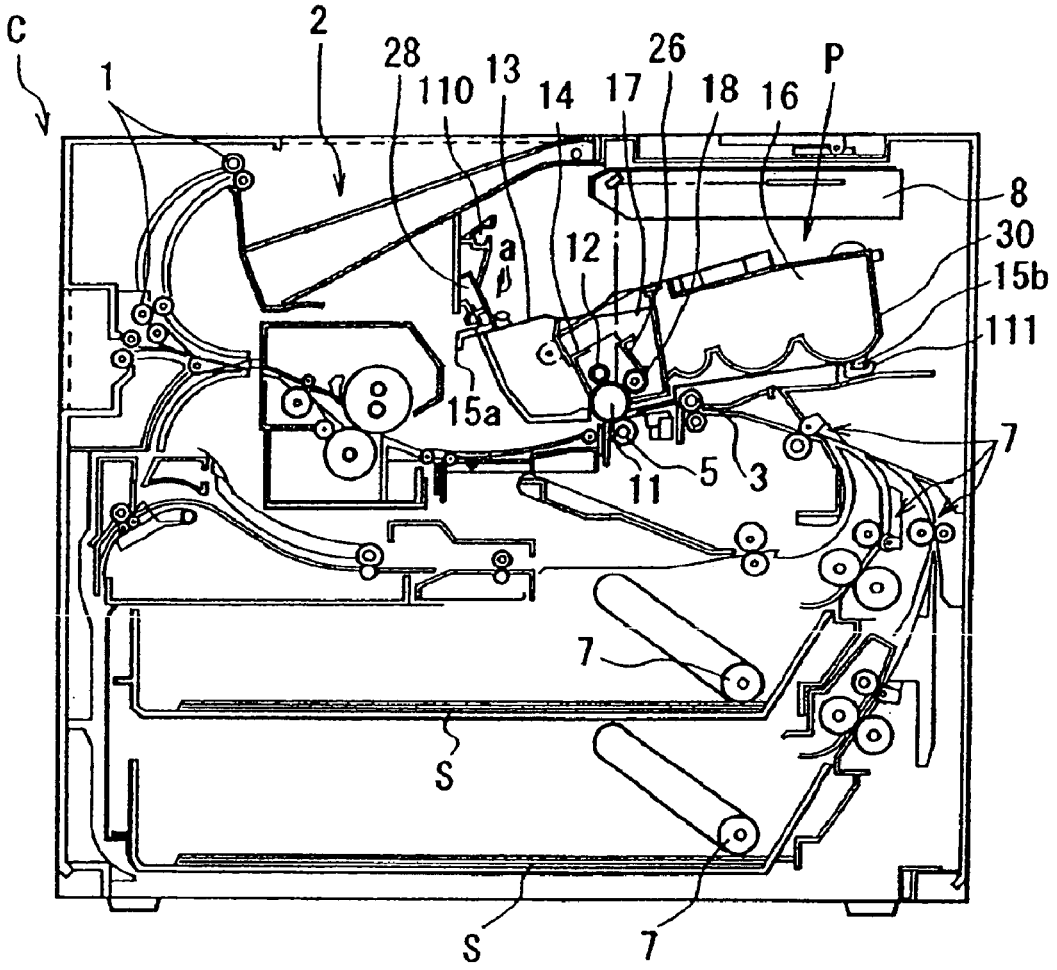
FIG. 1 is a vertical sectional view of an electrophotographic image forming apparatus, at a plane perpendicular to the axial line of the electrophotographic photoconductive drum.
Figure 2:
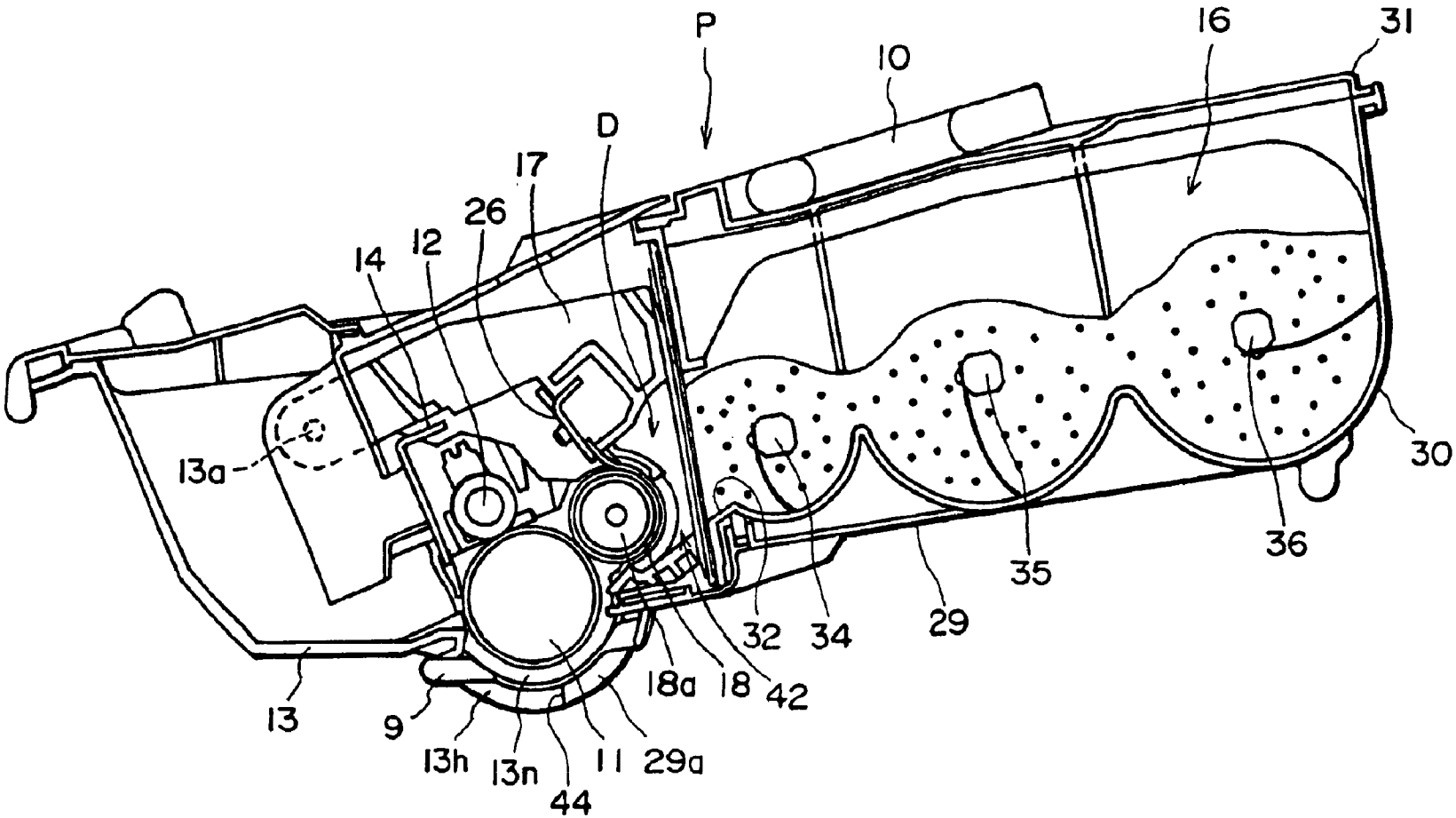
FIG. 2 is a vertical sectional view of a process cartridge at a plane perpendicular to the lengthwise direction of the axial line of the photoconductive drum.

FIG. 1 shows the vertical section of a typical electrophotographic image forming apparatus, perpendicular to the lengthwise direction, and FIG. 2 shows the vertical section of a typical process cartridge, perpendicular to the lengthwise direction.

The process cartridge P in this embodiment is structured as shown in FIG. 2. In other words, the process cartridge P comprises: a drum holding frame 13, in which a charge roller 12 as a charging means, and a cleaning blade 14 as a cleaning means, are disposed around an electrophotographic photoconductive drum 11; a developing means holding frame, as a developing apparatus D, which supports a development roller 18 and development blade 26; a toner storage unit in which stirring members 34, 35, and 36 for stirring the toner, and to which a toner storage lid 31 is welded.

A drum protection shutter 19 for protecting the photoconductive drum 11 is supported by the drum holding frame 13. These frame and shutter are integrated into the form of a cartridge P, which can be mount or dismount, into or from, the image forming apparatus main assembly C, without subjecting the processing means to an undue amount of force, by grasping a handle 10 provided on the top surface of the toner storage lid 31.

The shutter 9 takes a closed position at which it completely covers the transfer opening 13*n*, or an open position at which it fully exposes the transfer opening 13*n*. More specifically, as the cartridge P is moved out of the apparatus main assembly C, it moves from the open position to the closed position, preventing the photoconductive drum 11 from being physically damaged, or from being exposed to external light, and as the cartridge P is mounted into the apparatus main assembly C, it moves from the closed position to the opening position, exposing the transfer opening 13*n*, allowing the photoconductive drum 11 to directly oppose a transfer roller 5. The transfer opening 13*n* is narrow and long, and its dimension in terms of the lengthwise direction of the photoconductive drum 11 exceeds the image formation range in terms of the lengthwise direction of the photoconductive drum 11. The dimension of the transfer opening 13*n* in terms of the direction perpendicular to the lengthwise direction of the photoconductive drum 11 is greater than the diameter of the photoconductive drum 11. The transfer opening 13*n* is located between the drum holding frame 13 and developing means holding frame 17. In terms of the lengthwise direction, the position of one of the edges of the transfer opening 13*n* coincides with the position of the inward surface of the bearing cover portion 13*h* extending downward from the drum holding frame 13, whereas the position of the other edge coincides with the position of the inward surface of the bearing cover portion 29*a* extending downward from the bottom cover 29 attached to the developer holding frame 30. The bearing cover portions 13*h* and 29*a* are connected to each other at a joint 44, forming an arcuate portion, the center of which virtually coincides with the axial line of the photoconductive drum 11. The peripheral surface of the photoconductive drum 11 is exposed through this transfer opening 13*n*.

As described above, the positions of the short edges, that is, the edges at the lengthwise ends, of the transfer opening 13*n* coincide with those of the inward surfaces of the bearing cover portions 13*n* and 29*a*.

The cartridge P is mounted in an image forming apparatus such as the one shown in FIG. 1, to be used for image formation.

The photoconductive drum 11 is charged by the charge roller 12, and selectively exposed by an exposing apparatus 8, in accordance with the image formation data. As a result, an electrostatic latent image is formed. The exposing operation by the exposing apparatus 8 is carried out in synchronism with the conveyance of the sheet S by a registration roller pair 3.

Meanwhile, the toner in the toner storage unit 16 is conveyed to the development means holding frame 17, in which it is borne in a thin layer on the peripheral surface of the development roller 18 by the development blade 26. Then, development bias is applied to the development roller 18 so that the toner is supplied to the latent image on the peripheral surface of the photoconductive drum 11. As a result, a toner image is formed on the peripheral surface of the photoconductive drum 11. This toner image is transferred onto the aforementioned sheet S, which is being conveyed through the transfer station after having been conveyed thereto by the conveying rollers 7, by the application of bias voltage to the transfer roller 5. Then, the sheet S is conveyed to a fixing apparatus 4, in which the toner image is fixed to the sheet S. Then, the sheet S is discharged into a delivery portion 2 on top of the apparatus main assembly, by sheet discharge rollers 1. Meanwhile, the residual toner, that is, the developer remaining on the peripheral surface of the photoconductive drum 11, is removed by the cleaning blade 14, and is collected into the drum holding frame 13.

Structure of Process Cartridge Frame

Next, the developing apparatus and its adjacencies will be described further in detail.

Figure 3:
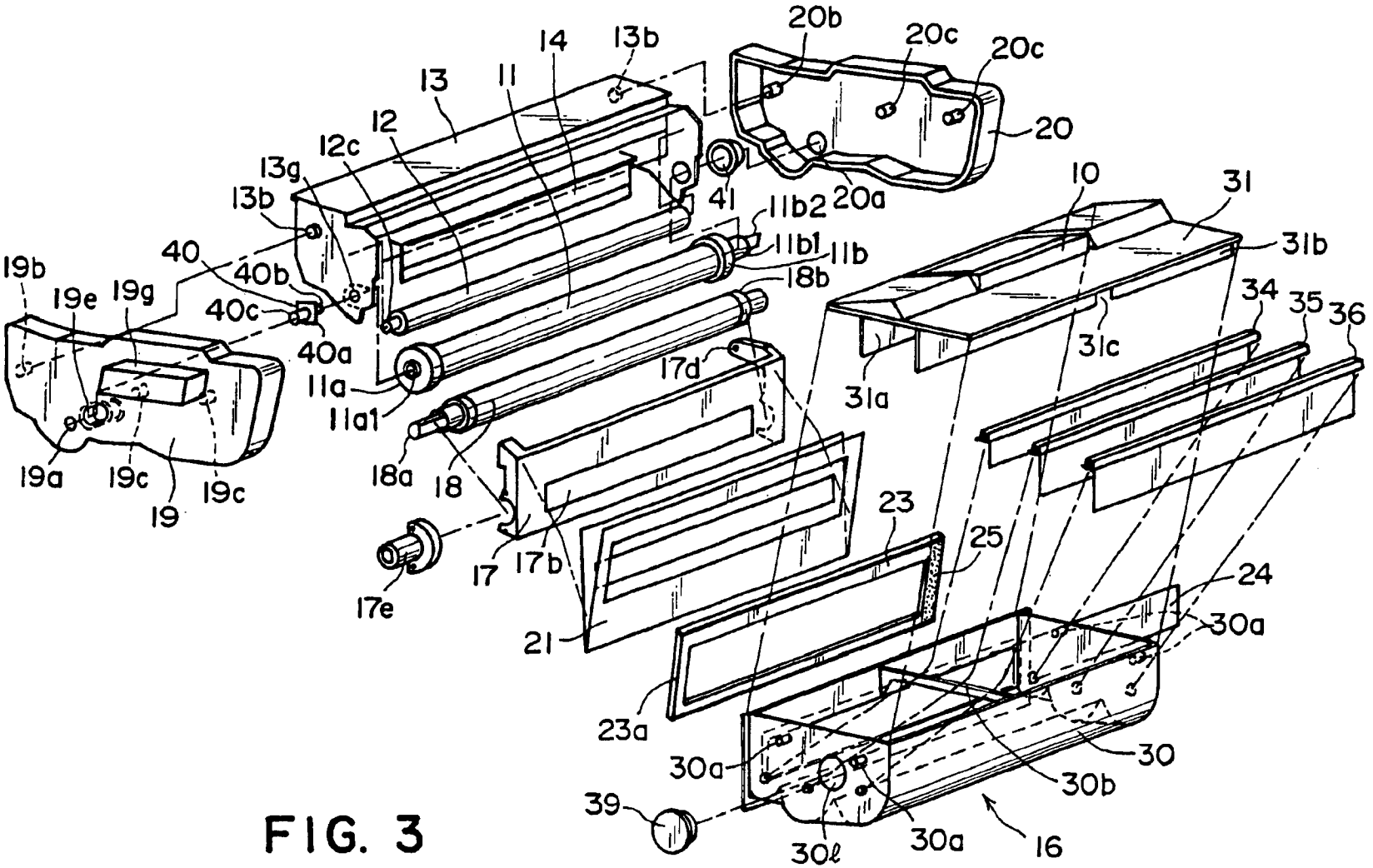
FIG. 3 is an exploded perspective view of the process cartridge.

FIG. 2 and 3 shows the structure of the cartridge P in this embodiment. The developing apparatus D of the cartridge P places the toner from the toner storage unit 16 onto the peripheral surface of the development roller 18, and then, supplies the toner on the peripheral surface of the development roller 18 to the peripheral surface of the photoconductive drum 11, in accordance with the latent image on the peripheral surface of the photoconductive drum 11, by applying development bias to the development roller 18.

The development roller 18 is cylindrical, and is formed of a metallic material such as aluminum or stainless steel. It contains a magnetic roller 18*a*.

FIG. 3 is an exploded perspective view of the cartridge P, for showing the components and structure of the cartridge P. The positional relationships between the toner storage unit 16 and end covers 19 and 20 become accurately fixed as the positioning joggles 30*a* protruding from the outward surfaces of the side walls, in terms of the lengthwise direction, of the developer holding frame 30, into the center holes of the bosses 19*c* and 20*c* of the end covers 19 and 20, respectively. The drum holding frame 13 rotationally supports the drum 11, with the interposition of a bearing 41 and a drum shaft 40 located at the lengthwise ends, one for one. The positioning joggle 19*b* and 20*b* are fitted into the center holes of the positioning bosses 13*b*, one for one. As a result, the drum holding frame 13 becomes fixed to the end covers 19 and 20 as is the toner storage unit 16.

In other words, the frame 13 and unit 16 are held together by the end covers 19 and 20. The shaft 40 is provided with a flange portion 40*a*, a first shaft portion 40*b*, and a second shaft portion 40*c*. The flange portion 40*a* is the portion by which the shaft 40 is attached to the frame 13, and the a first shaft portion 40*b* is the portion to be inserted into the center hole of the flange 11*a* of the drum 11. The second shaft portion 40*c* perpendicularly protrudes from the outward surface of the flange portion 40*a* (therefore, in the direction opposite to the direction in which the first shaft portion 40*b* protrudes), long enough to project outward through the hole 19*a* of the end cover 19. The aforementioned flange 11*a* is guided by a U-shaped groove 13*g* (contoured by a dotted line in FIG. 3, and contoured by a solid line in FIG. 17) in the inward surface of the frame 13, when the drum 11 is mounted in the frame 13. Further, the flange 11*a* has a guide portion 11*a*1 for temporarily keeping the drum 11 accurately positioned relative to the frame 13 until the attachment of the shaft 40. This guide portion 11*a*1 is cylindrical, and is smaller in diameter than the portion of the flange 11*a*, from the outward surface of which it perpendicularly projects. Its axial line coincides with that of the drum 11.

Referring to FIGS. 2 and 3, the developing means holding frame 17 of the developing apparatus D supports developing members such as the development roller 18, development blade 12, and the like. It is connected to the frame 13, with the pins inserted in the holes 13*a* (FIG. 6) of the frame 13 and the holes 17*a* of the developing means holding frame 17, being enabled to pivot about the axial line of the holes 17*d* (13*a*). Here, referring to FIG. 6, which shows one of the lengthwise ends of the cartridge P, with the end cover 20 removed, a tension coil spring 22 is stretched between the frame 13 and frame 17, being attached to the spring anchoring portions 13*c* and 17*f* projecting from the frames 13 and 17, respectively.

Figure 6:
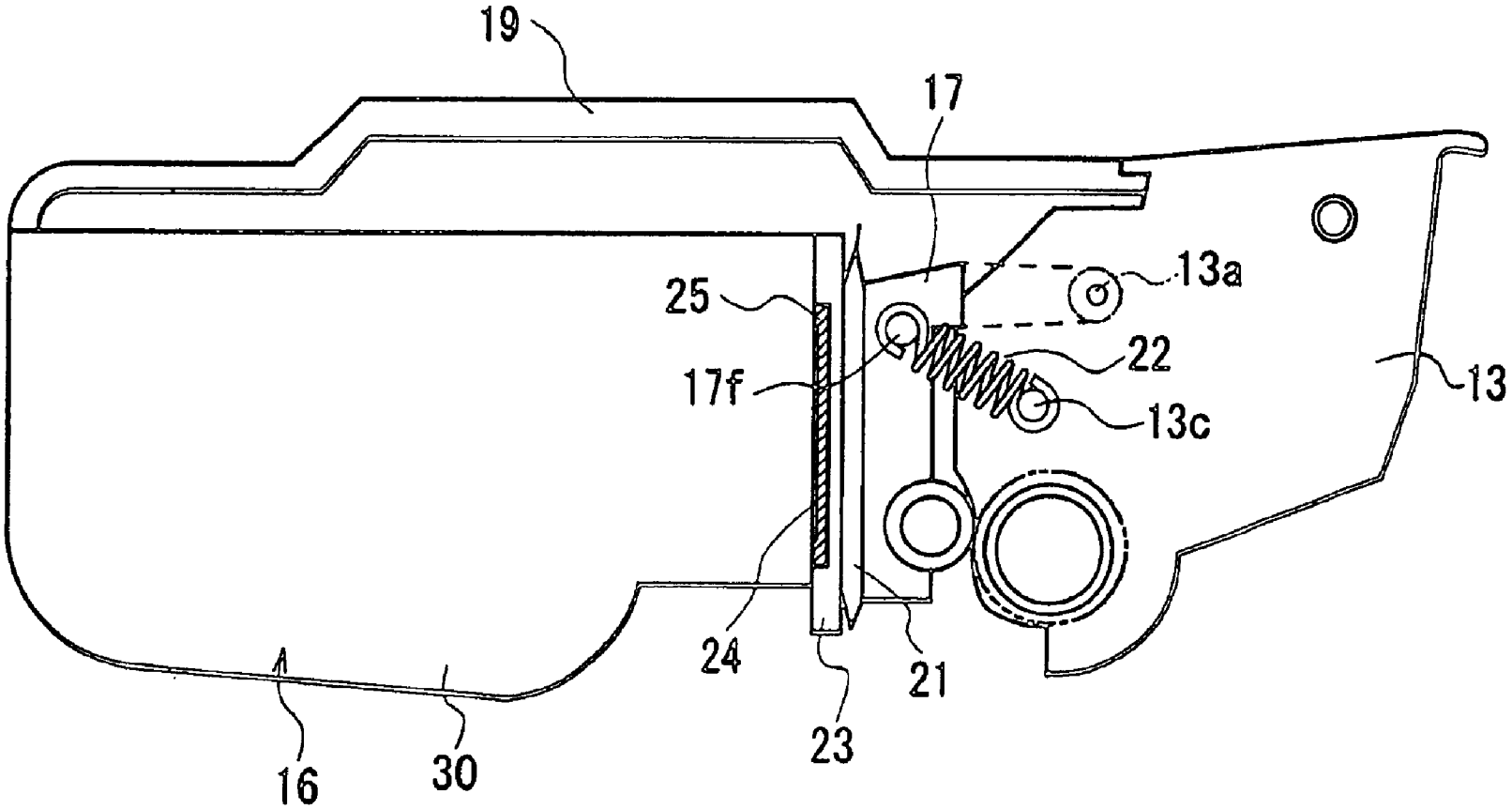
FIG. 6 is an external plan view of one of the lengthwise ends of the process cartridge, with the end cover removed.
Figure 7:
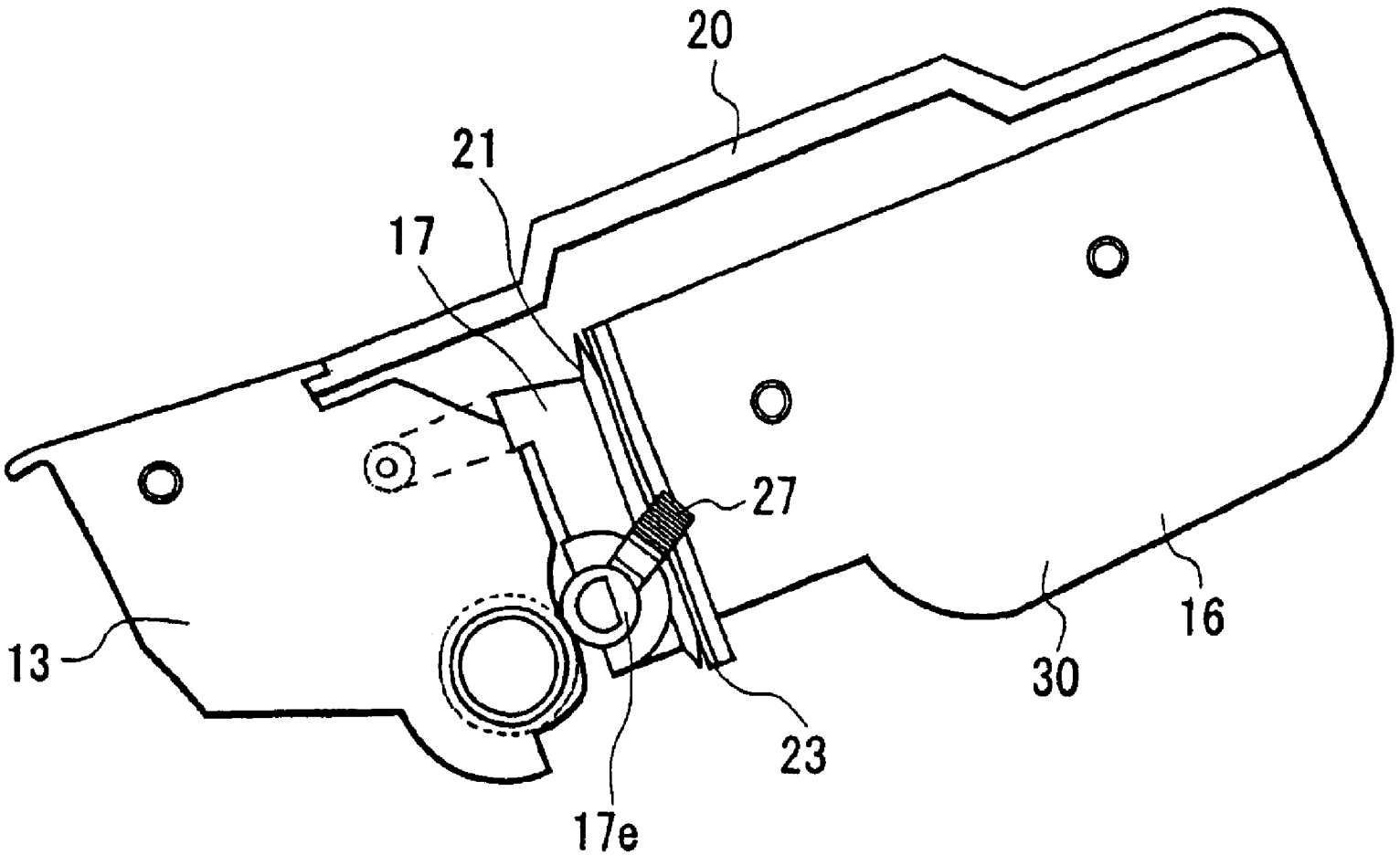
FIG. 7 is an external plan view of the other lengthwise end of the process cartridge, with the end cover removed.

Next, referring to FIG. 3, and FIG. 7 which shows the lengthwise end of the cartridge opposite to the end shown in FIG. 6, a compression coil spring 27 is fitted in a groove 19*e* of the end cover 19, being compressed so that it presses the development roller bearing 17*e*, which is secured to the lengthwise end of the frame 17, rotationally supporting one of the lengthwise ends of the development roller 18. With the presence of the force from the spring 22, a pair of spacer rings 18*b*, which are greater in radius by an amount equivalent to the development gap (approximately 300 $\mu$m) than the photoconductive drum 11 and are concentrically fitted around the lengthwise end portions of the development roller 18, are kept pressed upon the peripheral surface of the photoconductive drum 11, outside the image formation range. With the provision of this structural arrangement, a gap is provided between the developing means holding frame 17 and developer holding frame 13.

In this embodiment, the gap between the developing apparatus D and developer holding frame 30 is sealed with a sealing member in the formed of follows, which is made by folding and pasting a jointing sheet 21 attached to the developer holding frame 30 with the inter position of a jointing plate 23. The jointing sheet 21 in this embodiment is no more than 1 mm in thickness. However, the jointing sheet thickness may be more than 1 mm, provided that the substance selected as the material for the jointing sheet 21 is such that even if it is made into a jointing sheet thicker than 1 mm, it does not prevent the bellows-like jointing member, into which the jointing sheet is fold, from remaining flexible.

Figure 12:
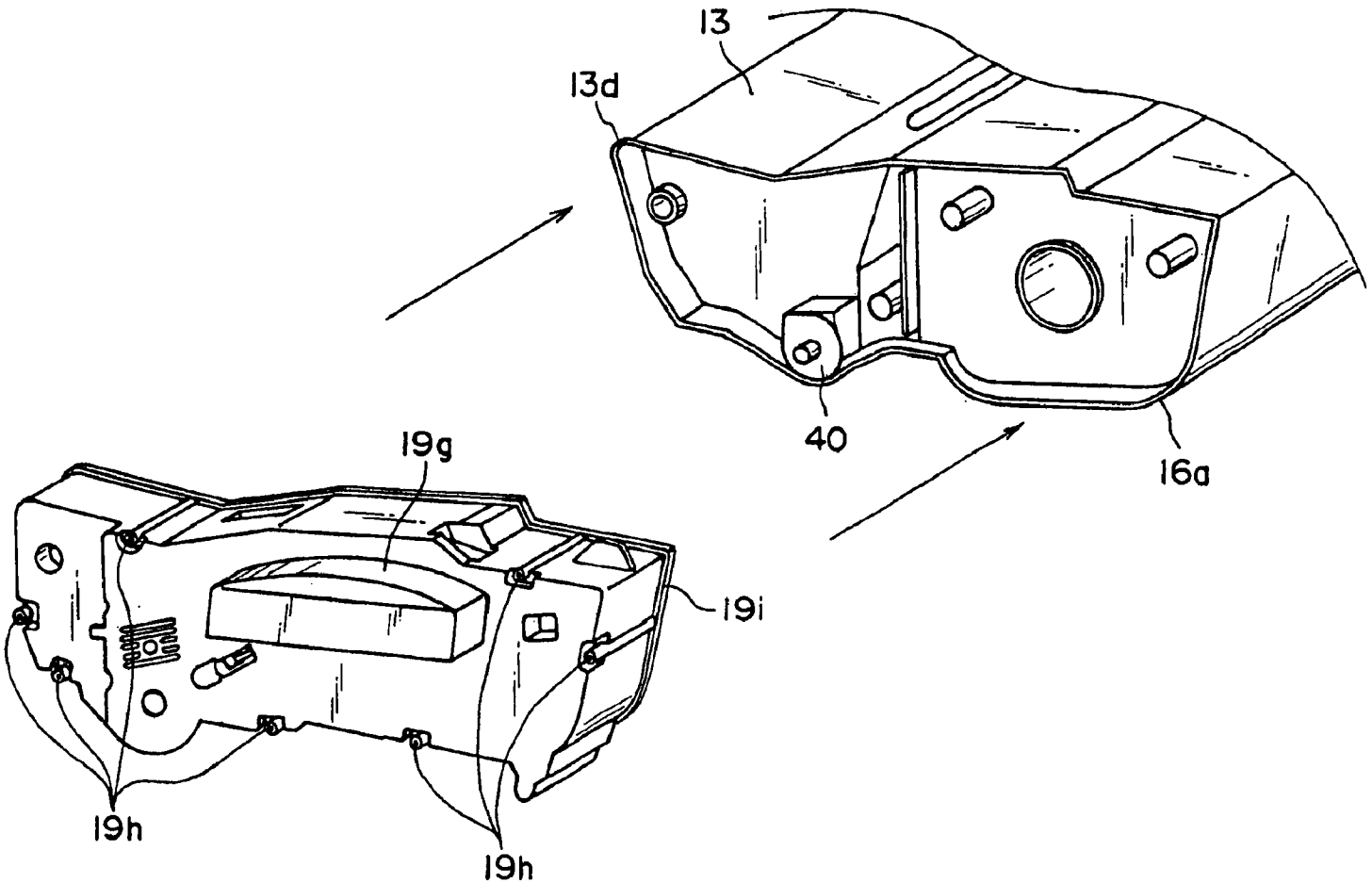
FIG. 12 is a perspective view of the end cover and corresponding lengthwise ends of the drum holding frame and developer holding frame, at one of the lengthwise ends of the process cartridge, for showing the method for attaching the end cover.

Referring to FIG. 12, the outwardly edge 13*d* of the drum holding frame 13, the outward edge 16*a* of the toner storage unit 16, and inward edge 19*i* of the end cover 19, are structured so that as the combination of the drum holding frame 13 and toner storage unit 16 is joined with the end cover 19, a groove (unshown) is formed, into which melted resin is flowed through the gate 19h of the end cover 19. As melted resin is flowed into this groove, the frame 13, unit 16, and end cover 19 are solidly secure to each other. The, the end cover 20 is also joined with the combination of the frame 13 and unit 16, in the same manner as is the end cover 19, completing the cartridge P.

Figure 17:
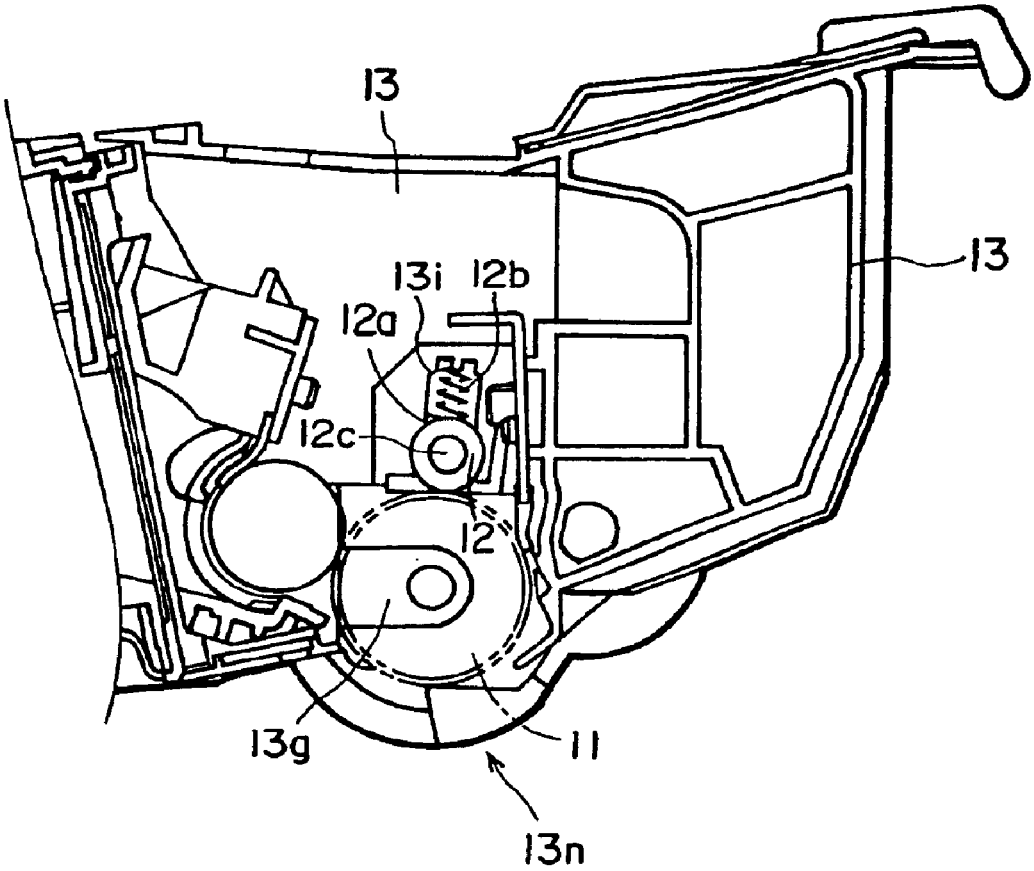
FIG. 17 is a vertical sectional view of the cleaning means holding frame, for depicting the U-shaped groove.

The charge roller 12 comprises a metallic core 12*c*, and a cylindrical rubber layer (FIG. 3) fitted around the metallic core 12*c*. The electrical resistance of the rubber layer is in the mid range. Referring to FIG. 17, the frame 13 is provided with a guide-way 13*i*, which extends in the lengthwise direction of the frame 13 in parallel to the axial line of the photoconductive drum 11, astride the axial line of the photoconductive drum 11, in terms of the direction perpendicular to the lengthwise direction of the photoconductive drum 11. In this guide-way 13*i*, a charge roller bearing 12*a* is slidably fitted. In this bearing 12*a*, the metallic core 12*c* of the charge roller 12 is rotationally fitted. At the rear end of the cartridge P, a compression coil spring 12*b* is disposed between the guide-way 13*i* and bearing 12*a*. The spring 12*b* is fitted around a projection of the charge roller bearing 12*a*, with the anchoring portion of the spring 12*b* tightly fitted around the base portion of the projection, facilitating the process cartridge assembly. With this structural arrangement, the charge roller 12 is kept pressed upon the drum 11, by the pressure applied to the charge roller 12 by the resiliency of the spring 12*b* through the bearing 12*b*. Incidentally, the charge roller 12 is rotated by the rotation of the photoconductive drum 11.

Method for Forming Pouch-like Sealing Member

Figure 4:
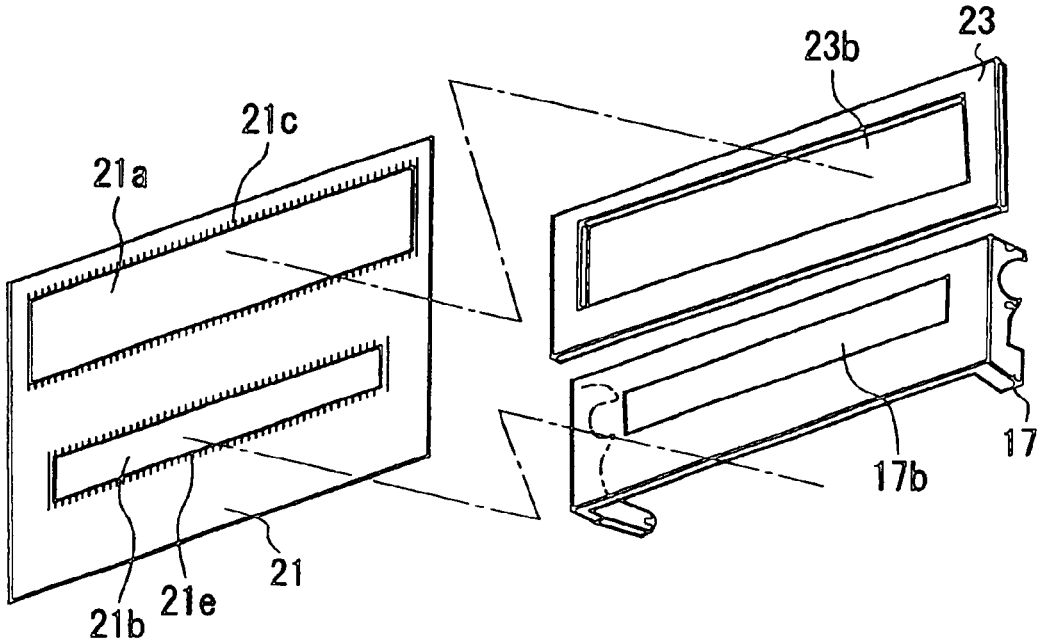
FIG. 4 is a perspective view of the sealing member.
Figure 5:
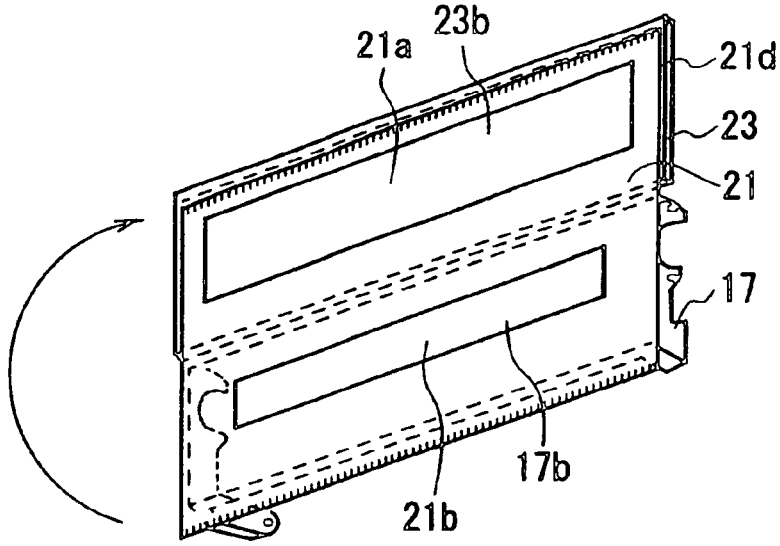
FIG. 5 is a perspective view of the sealing member.

Next, referring to FIGS. 4 and 5, a method for forming the pouch-like sealing member from the jointing sheet 21 is roughly described. Referring to FIG. 4, the jointing sheet 21 is provided with holes 21*a* and 21*b*, the sizes of which are approximately the same as, or greater than, those of the holes 23*b* and 17*b* of the jointing plate 23 and developing means holding frame 17, respectively. The jointing sheet 21 is attached to the edges of the holes 23*b* and 17*b* of the jointing plate 23 and developing means holding frame 17, by the edge portions 21*c* and 21*e* of the holes.

In this embodiment, the jointing sheet 21 is attached to the developing means holding frame 17 and jointing plate 23 by a thermal welding method, such as a thermal sealing method or an impulse sealing method. However, ultrasonic welding, adhesive, adhesive tape, or the like methods, may be used.

After being attached to the developing means holding frame 17 and jointing plate 23, the jointing sheet 21 is folded in the direction indicated by an arrow mark, as shown in FIG. 5, so that the holes 21*a* and 21*b* squarely face each other (holes 23*b* and 17*b* squarely face each other). Then, the two sections of the jointing sheet 21 created by the folding are attached to each other, by the entirety of the edge portion 21*d*, creating a bellows-like (pouch-like) member. The means for attaching the above described two sections of the jointing sheet 21 may also be a thermal welding method such as a heat sealing method or an impulse sealing method, a ultrasonic welding, adhesive, adhesive tape, or the like.

Next, the jointing plate 23 is attached to the developer holding frame 30, leaving partially unwelded or unpasted to provide a gap through which a toner seal 24 can be passed. In this embodiment, the portion 23*a* is welded or pasted to the surface 30*h* (FIG. 10) of the frame 30 provided with a hole 32 as a toner delivery hole, except for the area across which the toner seal 24 is kept pressed by a toner sealing member 25 (FIG. 3).

The provision of the above described structural arrangement, in other words, the placement of the a pouch-like bellows formed of the jointing sheet 21 between the mutually facing surfaces of the frame 30 and frame 17 minimizes the resistance which occurs as the distance between the mutually facing surfaces of the frame 30 and frame 17 varies. Further, the placement of the jointing sheet 21 between the jointing plate 23 and developing means holding frame 17 makes it possible to attach the jointing plate 23 in a manner to cover the toner seal 24. With the provision of this arrangement, the toner sealing member 25 can be placed in the gap through which the toner seal 24 is passed, preventing toner leak (FIG. 6).

The provision of the jointing plate 23 makes simpler the configuration of the welding table necessary for welding the jointing sheet 21 to the mutually facing surfaces of the frame 17 and jointing plate 23, compared to that necessary in the absence of the jointing plate 23, that is, when the jointing sheet 21 has to be directly pasted to the frame 30.

Further, the provision of the jointing plate 23 makes it possible to assemble the developing means holding frame 17, jointing plate 23, and jointing sheet 21 into a unit which can be easily attached to the frame 30. The frame 17 and unit 16 jointed together into a development unit.

Mounting or Dismounting of Process Cartridge into or out of Apparatus Main Assembly FIG. 1 is a sectional view of an image forming apparatus, in which the cartridge P is ready for image formation. In order to dismount the cartridge P in the state shown in FIG. 2, a lever (unshown) located on the front wall of the apparatus main assembly C is to be rotated. As the lever is rotated, an arm 28 is rotated in the direction indicated by an arrow mark (a). As a result, the left side of the cartridge P, with reference to the drawing, is raised by a part (unshown) of the arm 28. As the left side of the cartridge P is raised, the cartridge P rotates, while being raised, about the guide portions 15*b* rested on the guide rails 111 of the apparatus main assembly C, until the guide portions 15*a*, with which only the back side of the cartridge P is provided, aligns with the guide rails 110 of the apparatus main assembly C. In this state, the cartridge P is to be pulled toward the front side of the apparatus main assembly C, in the direction perpendicular to the plane of the FIG. 1. As the cartridge P is pulled, the guide portions 15*a* transfers onto the guide rails 110, and the cartridge P becomes disengaged from the arm 28. Then, the cartridge P can be pulled straight out of the apparatus main assembly C.

The procedure for mounting the cartridge P into the apparatus main assembly C is reverse to the above described dismounting procedure. In other words, the cartridge is to be inserted into the apparatus main assembly C, with the guide portion 15*a* and fulcrum 15*b* aligned with the rails 110 and 111, in the direction perpendicular to the plane of the FIG. 1. As the cartridge is inserted inward of the apparatus main assembly C, the top left portion of the cartridge P is caught by the arm 28 before the guide portion 15*a* becomes disengaged from the rail 110. Then, as the cartridge P is pushed further into the apparatus main assembly C, the guide portion 15*a* disengages from the rail 110. Then, a lock (unshown) of the arm 28 is to be disengaged, and the aforementioned lever (unshown) on the front side of the apparatus main assembly C is to be rotated to rotate the arm 28 in the direction opposite to the direction indicated by the arrow mark (a). The rotation of the arm 28 is assisted by the weight of the cartridge P itself.

As the cartridge P approaches the position at which the cartridge can form an image, the second shaft portion 40*c* of the drum shaft 40 (FIG. 3) protruding outward of the end cover 19, through the aforementioned hole 19*a* of the end cover 19, shown in FIG. 3, fits into the drum shaft positioning recess (unshown) of the apparatus main assembly C, being therefore accurately positioned (drum bearing 41 on the end cover 20 side protrudes outward through the hole 20*a* of the end cover 20). As a result, the cartridge P is accurately positioned relative to the apparatus main assembly C, and therefore, the photoconductive drum 11 is accurately positioned relative to the apparatus main assembly C, because the axial lines of the photoconductive drum 11, drum bearing 41, and drum shaft 40 coincide.

The side wall of the end cover 19, which surrounds the second shaft portion 40*c*, makes contact with the inward surface of the portion of apparatus main assembly C with the recess (unshown) in which the shaft portion 40*c* fits. As a result, the position of the cartridge P relative to the apparatus main assembly C in terms of the lengthwise direction is accurately fixed. With the provision of the above described structural arrangement, even a process cartridge (P), which is heavy because of a large amount of toner contained in the developer holding frame 30, can be smoothly mounted into, or dismounted from, the apparatus main assembly C. Incidentally, the cartridge P is also provided with a handle 19*g* (FIG. 12), in addition to the handle 10 on the top surface. The handle 19*g* is attached to the second end cover 19, being on the front side in terms of the direction in which the cartridge P is mounted or dismounted. The provision of the additional handle 19*g* makes it easier to carry the cartridge P, and also to handle the cartridge P at the beginning of the mounting of the cartridge P or the end of the dismounting of the cartridge P.

The flange 11*b* of the drum 11, on the driven side, comprises a journal portion 11*b*1, which is rotationally supported by the bearing 41, and a driving force receiving portion 11*b*2, which projects from the journal portion 11*b*1. The driving force receiving portion 11*b*2 is in the form of a triangular pillar which is twisted about its axial line, and has a cross section in the form of an equilateral triangle. It is driven by the driving shaft on the apparatus main assembly C side, being fitted into the twisted triangular hole (unshown) of the driving shaft.

Description of Toner Storage Unit

Figure 8:
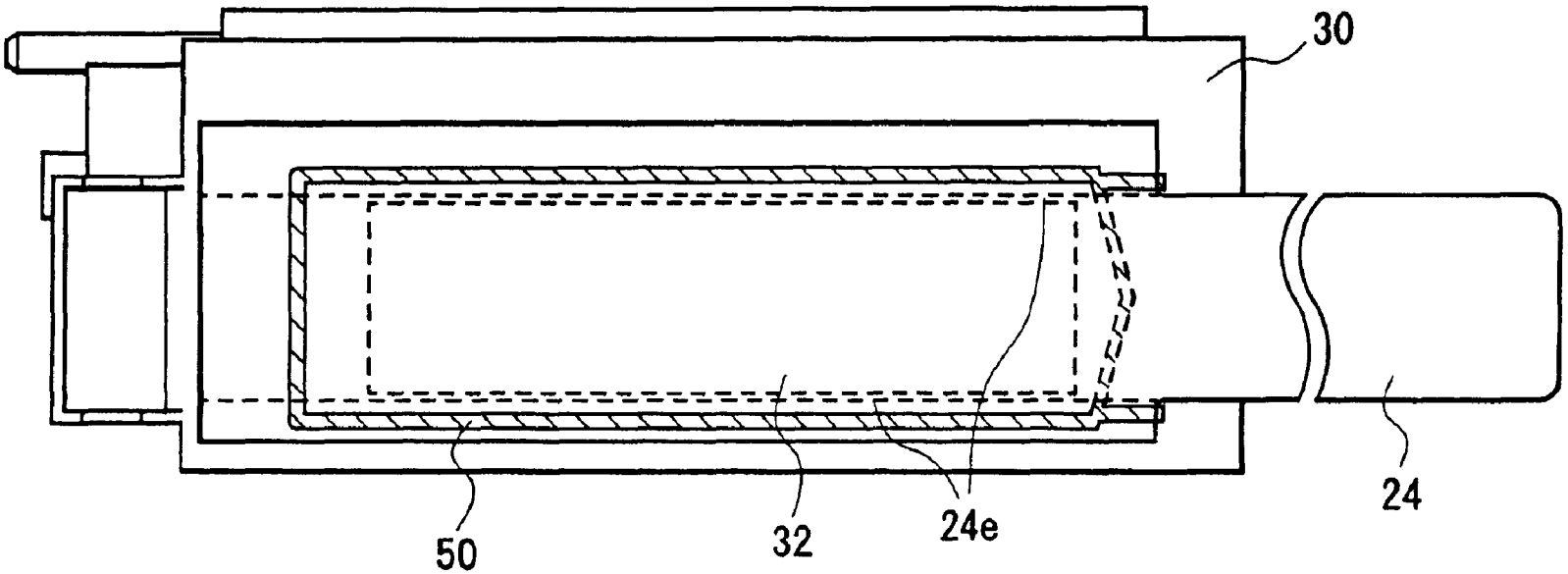
FIG. 8 is a plan view of the toner seal of the developer holding frame.

Next, referring to FIGS. 8, 9, 10, and 11, the unit 16 will be described. The unit 16 comprises the frame 30, toner storage lid 31, and stirring members 34, 35, and 36. Referring to FIG. 8, the frame 30 is provided with the developer delivery hole 32 through which the toner is sent out to the developing means holding frame 17. The hole 32 is covered with the seal 24, which is thermally welded to the unit 16, along the surrounding edge of the hole 32 (FIG. 8). A referential code 50 stands for the welded portion (hatched portion).

Figure 9:
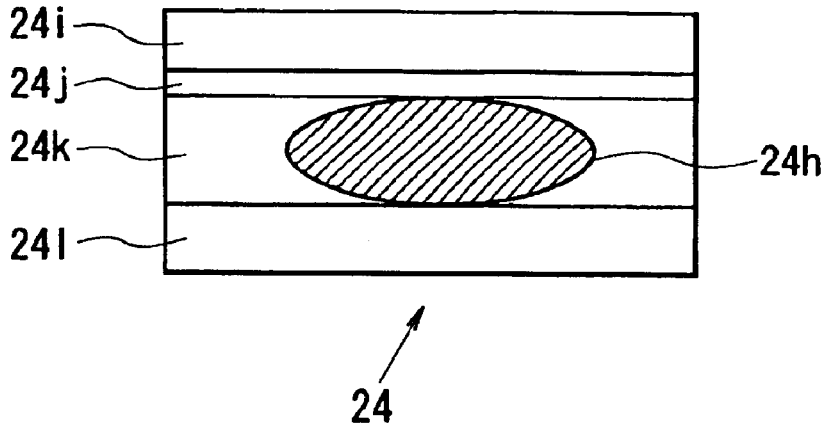
FIG. 9 is a sectional view of the toner seal.

The toner seal 24 in this embodiment has a laminar structure, having:

a 12 μm thick polyester layer (strength providing layer: 24*i* in FIG. 9), a 7 μm thick aluminum foil layer (laser beam blocking layer: 24*j* in FIG. 9), a 50 μm thick polyester layer (tear guiding layer: 24*k* in FIG. 9), and a 50 μm thick sealant layer (adhesive layer: 241 (el) in FIG. 9), listing from the top layer.

Tear lines 24*e* of the seal 24, along which the seal 24 is torn open, have been subjected to a laser-cut process for creating gaps in the tear guiding layer, along the tear lines 24*e*. FIG. 9 is a sectional view of the seal 24. The seal 24 has a gap 24*h* created by a laser. The provision of the aluminum foil layer 24*j* which blocks a laser beam prevents the top polyester layer, or the strength providing layer 24*i*, from being damaged by the laser beam, assuring satisfactory sealing performance. The provision of the aluminum foil layer also causes the stress to concentrate to the gap 24*h* when the seal 24 is pulled to be opened, ensuring that the seal 24 is torn along the tear lines 24*e*.

Figure 10:
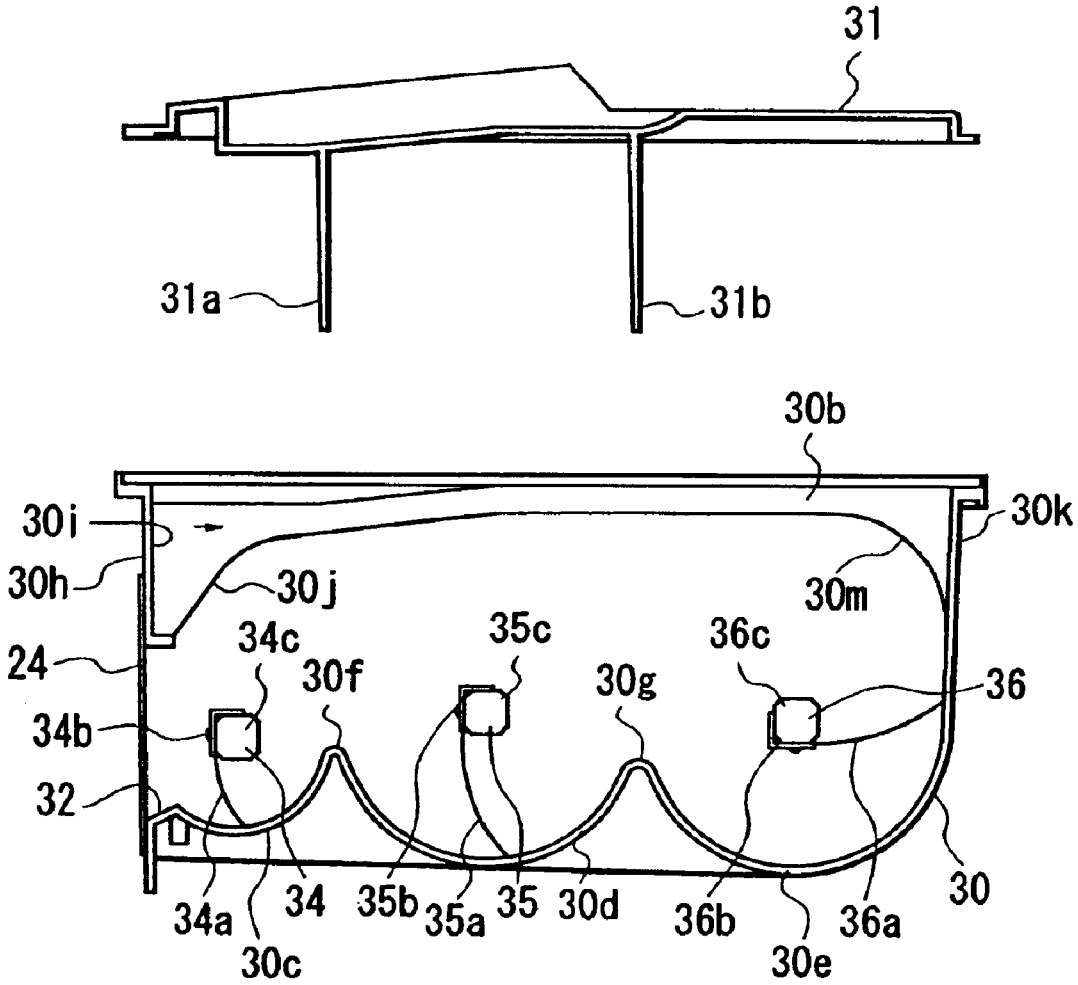
FIG. 10 is a sectional view of the toner storage unit, before welding.
Figure 11:
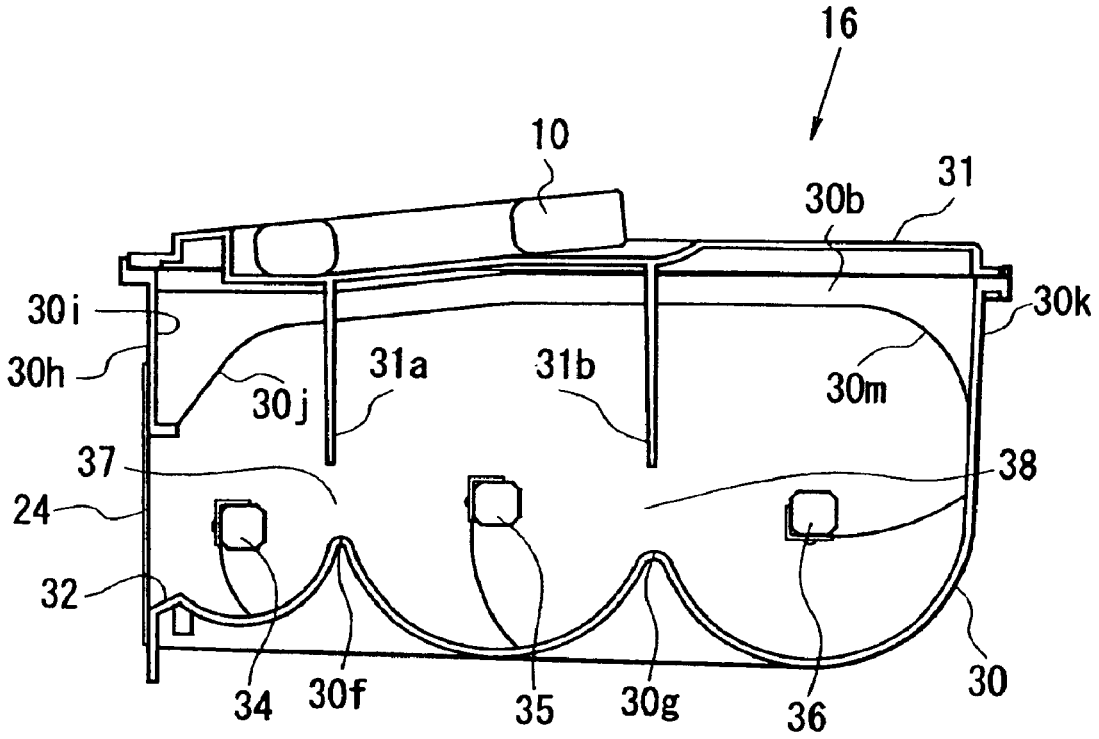
FIG. 11 is a sectional view of the toner storage unit, after welding.

Referring to FIG. 10, within the frame 30, the stirring members 34, 35, and 36 are provided, which send the toner to the developing means holding frame 17 through the toner delivery hole 32, while stirring the toner. The stirring members 34, 35, and 36 comprise: shaft 34*c*, 35*c*, and 36*c*; stirring blades 34*a*, 35*a*, and 36*a*; and blade holders 34*b*, 35*b*, and 36*b*, by which the stirring blades 34*a*, 35*a*, and 36*a*, are held to the shafts 34*c*, 35*c*, and 36*c*, respectively. In this embodiment, the blade 34*a* is formed of 50 μm thick PPS sheet, and blades 35*a* and 36*a* are formed of approximately 100 μm thick PPS sheet. The stirring members 34, 35, and 36 all rotate in the same direction (clockwise in FIG. 2). The stirring member 34, that is, the stirring member nearest to the developing means holding frame 17 rotates at approximately 20 rpm, and the other two stirring members 35 and 36 rotate at approximately 5 rpm.

The bottom wall of the frame 30 is shaped so that its cross section looks as if it is made by connecting three semicircles: 30*c*, 30*d*, and 30*e*, the centers of which coincide with the axial lines of the shafts 34*c*, 35*c*, and 36*c*, respectively. The distances from the axial lines of the shafts 34*c*, 35*c*, and 36*c* to the tips of the blades 34*a*, 35*a*, and 36*a*, when the blades are straight, are made greater than the radii of the semicircular portions 30*c*, 30*d*, and 30*e*, respectively, making it possible for the blades 34*a*, 35*a*, and 36*a* to stir the toner while scraping the bottom wall of the frame 30. Therefore, even after the remaining amount of the toner becomes small due to toner delivery, the blades can scrape the toner away from the bottom wall, and send the toner to the developing means holding frame 17, reducing the amount of the unusable toner, or the toner which fails to be delivered and remains in the developer holding frame 30. In this embodiment, the distances the blades 34*a*, 35*a*, and 36*a* hypothetically invade into the semicircular portions 30*c*, 30*d*, and 30*e*, respectively, of the bottom wall are 2–4 mm.

Within the frame 30, a bridge-like rib 30*b* is provided, which extends from the internal surface 30*i* of the wall 30*h* to which the aforementioned jointing plate 23 is attached in a manner to cover the hole 32, to the rear wall 30*k*, in terms of the cartridge mounting direction, of the frame 30. The bottom edge of the rib 30*b* is contoured so that it does not interfere with the installation of the stirring member 34 into the frame 30, being slanted across the portion 30*j* near the edge of the hole 32, and being arcuate across the portion 30*m* next to the rear wall 30*k*.

The lid 31 is provided with isolation ribs 31*a* and 31*b*, which extend in the lengthwise direction of the cartridge. In terms of the direction perpendicular to the lengthwise direction of the cartridge, the positions of the isolation ribs 31*a* and 31*b* virtually coincide with the position of the joint 30*f* between the semicircular portions 30*c* and 30*d*, and the position of the joint 30*g* between the semicircular portions 30*d* and 30*e*, of the bottom wall of the frame 30. In order for the ribs 31*a* and 31*b* not to interfere with the rib 30*b* within the developer holding frame 30, the center portions 31*c* of the rib 31*a* and 31*b* have been cut out (FIG. 3). After the installation of the stirring members 34, 35, and 36 into the frame 30, the lid 31 and frame 30 are welded to each other by ultrasonic welding or vibration welding, completing the toner storage unit 16. The gaps 37 and 38 left between the ribs 31*a* and 31*b* and the protruding joints 30*f* and 30*g* are the gaps necessary for sending out the toner. In this embodiment, the gaps are approximately 10 mm–30 mm wide.

After assembling the unit 16 as described above, the frame 30 is filled with the toner through the toner inlet 30*l* (el), and is sealed with a toner cap 39, completing the unit 16.

The inlet 30*l* (el) is provided as a filling opening at one of the lengthwise ends of the frame 30.

Embodiment 1 of Process Cartridge Remamufacturing Method in Accordance with Present Invention Next, a method for overhauling the cartridge P in this embodiment will be described.

Figure 22:
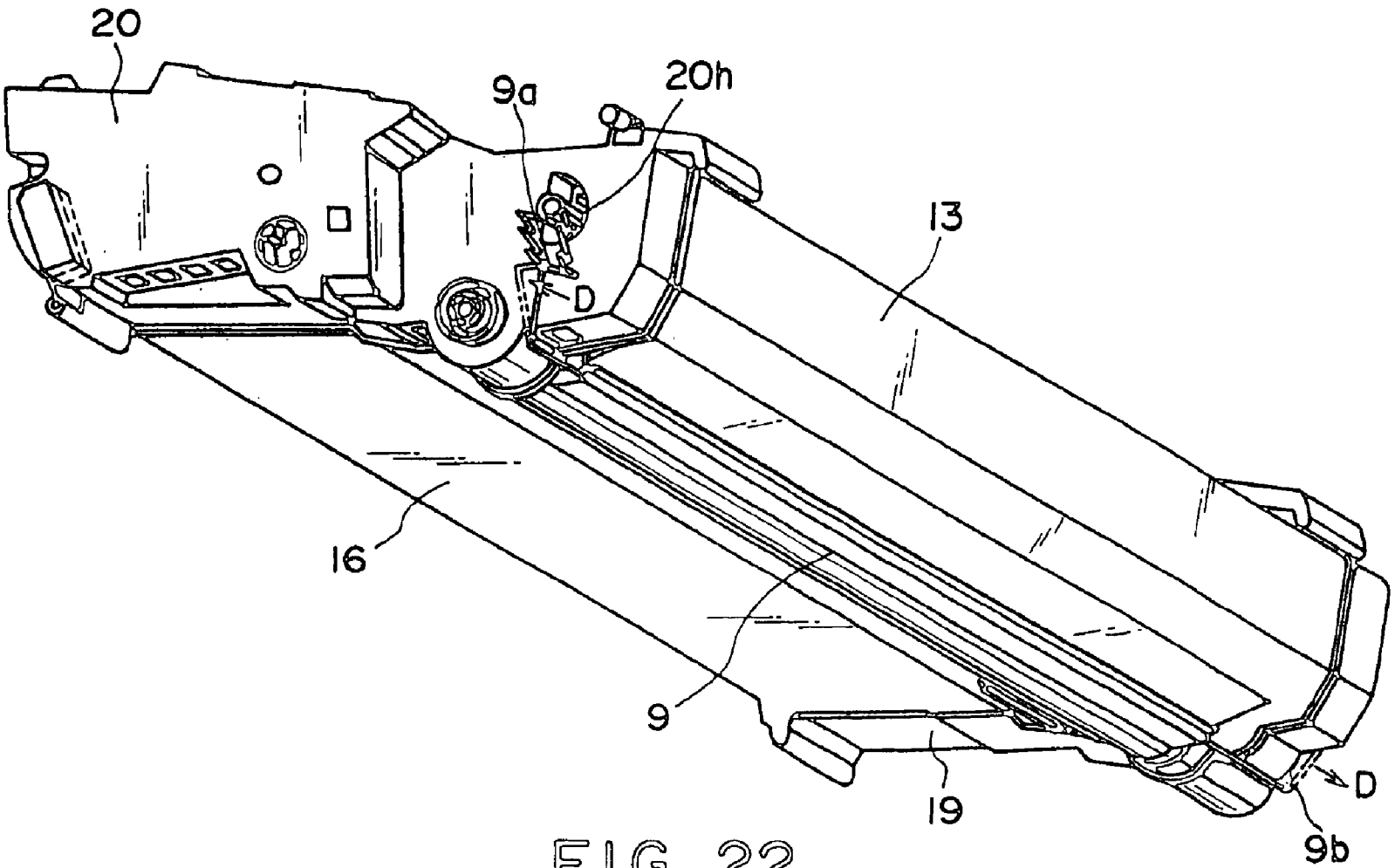
FIG. 22 is a perspective view of the process cartridge as seen from diagonally below.

First, referring to FIG. 22, the shafts 9*a* and 9*b* of the shutter 9 fitted in the holes 19*h* and 20*h* of the end covers 19 and 20 are removed from the end covers 19 and 20 by being bent in the direction indicated by an arrow mark D, against their resiliency. Incidentally, the shafts 9*a* and 9*b* are integral parts of a member engaged with the shutter 9. The shafts 9*a* and 9*b* are formed of spring steel.

Next, the cartridge P is secured to a chuck (unshown) of a milling machine. Then, a milling cutter 60 is positioned in a manner to cut into the welded portions 19*i* of the seam between the inward edge of the end cover 19 and outward edge of the drum holding frame 13, or the seam between the inward edge of the end cover 19 and outward edge of the frame 30, and is moved along the inward edge of the end cover 19, cutting through the welded portions 19*i*. The milling cutter 60 is a metal circular saw having teeth suitable for cutting through synthetic resin. As a result, the end cover 19 is released from the cartridge P. In this embodiment, a milling cutter is used for cutting, but a ultrasonic cutter, a heated blade, a rotating blade other than a milling cutter, or the like, may be used as the tool for disassembly. As for the choice of the milling machine for cutting the welded portion 19*i*, an NC milling machine is most suitable.

Figure 14:
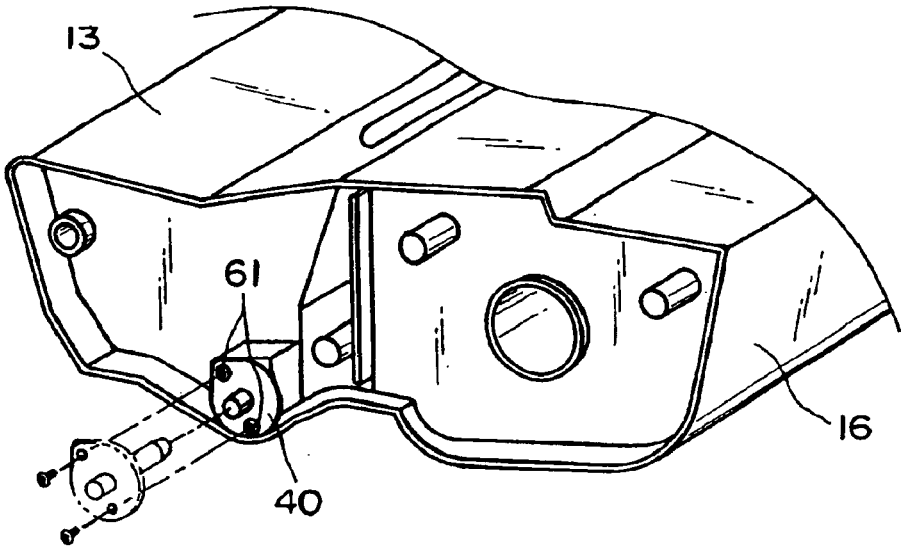
FIG. 14 is a perspective view of one of the lengthwise end of the process cartridge, with the end cover removed.
Figure 15:
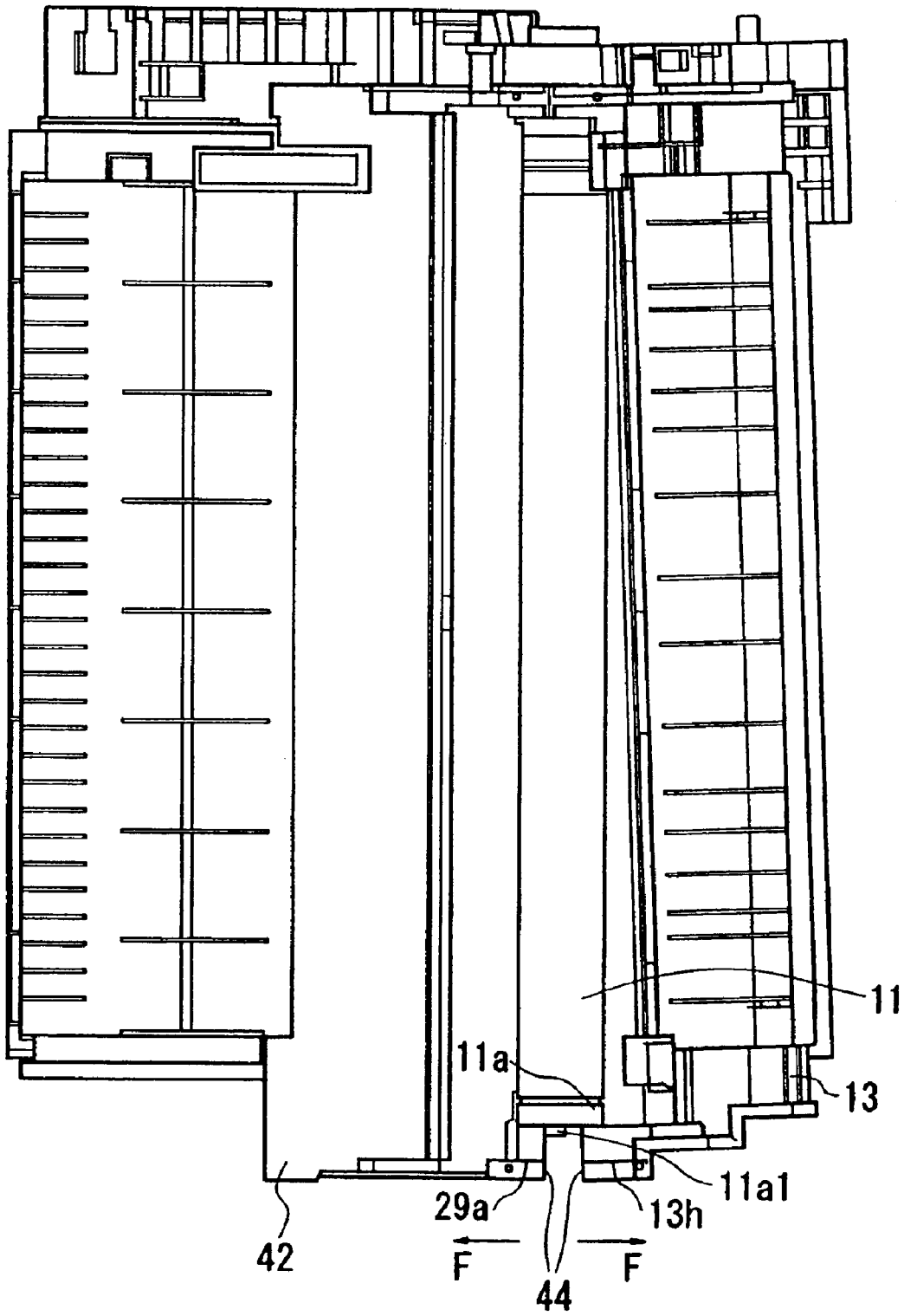
FIG. 15 is a plan view of the process cartridge, as seen from below during its disassembly.
Figure 16:
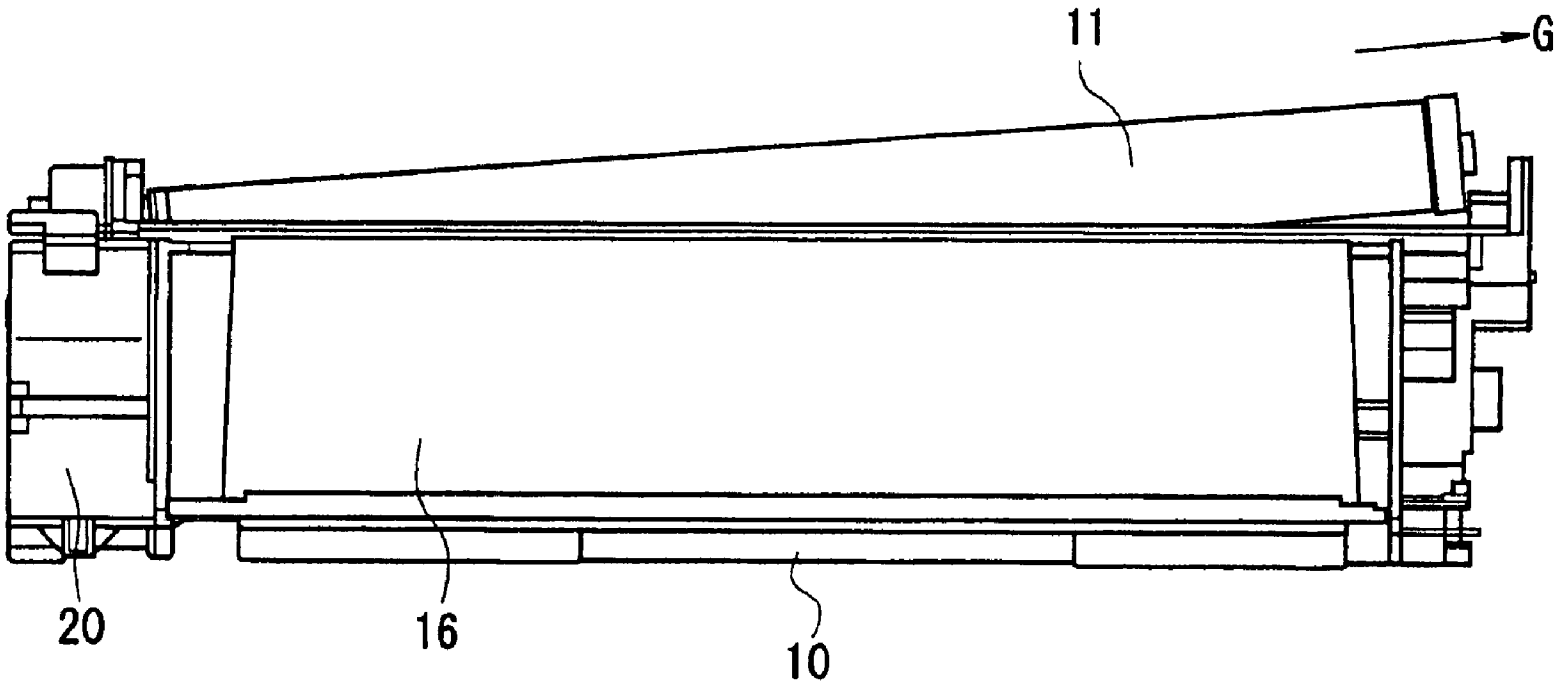
FIG. 16 is a plan view of the process cartridge, as seen from the toner storage unit side during its disassembly.

Thereafter, the small screws 61 holding the drum shaft 40 to the drum holding frame 30 are removed to disengage the drum shaft 40 from the frame 30, as show in FIG. 14. Incidentally, the drum shaft 40 is interposed between the photoconductive drum 11 and drum holding frame 30 to rotationally support the photoconductive drum 11 by the drum holding frame 30. Next, referring to FIG. 15, the guide portion 11*al* of the flange 11*a* having a gear is moved sideways following the U-shaped groove 13*g* (FIG. 17) of the drum holding frame 13, and is disengaged from the groove 13*g*, while forcefully keeping widened the gap between the frame 13 and development unit 42, on the end cover 19 side. Then, the photoconductive drum 11 is removed from the drum holding frame 13, in the diagonally upward direction indicated by an arrow mark G in FIG. 16, through the transfer opening 13*n*, while the gap between the drum holding frame 13 and development unit 42 is still kept forcefully widened. During this procedure, the components fixed to the end covers 19 and 20 are distorted. However, there will be no problem, because the extent of their distortion remains within a reversible distortion range afforded by the elasticity of their material.

After the photoconductive drum 11 is removed from the cartridge P, the cleaning blade 14 attached to the inward side of the drum holding frame 13 is examined for damages. With the presence of damages, first, the charge roller 12 is removed through the transfer opening 13*n*, and the cleaning blade 14 is removed by removing the small screws 62 holding the cleaning blade 14. When the toner which was removed from the photoconductive drum 11 and collected into the drum holding frame 13 remains by a substantial amount in the drum frame 13, the toner is removed. Then, the removed blade 14 is reattached to the inward side of the frame 13, with the use of the small screws 62, provided that the blade 14 was not damaged. When the removed blade 14 was damaged, a new one is attached. For the removal of the transfer residual toner within the frame 13, a nozzle is inserted into the frame 13 through the transfer opening 13n, and the toner is vacuumed out through the nozzle. Another nozzle may be inserted into the frame 13 to blow air into the frame 13 to blow out the toner.

Figure 19:
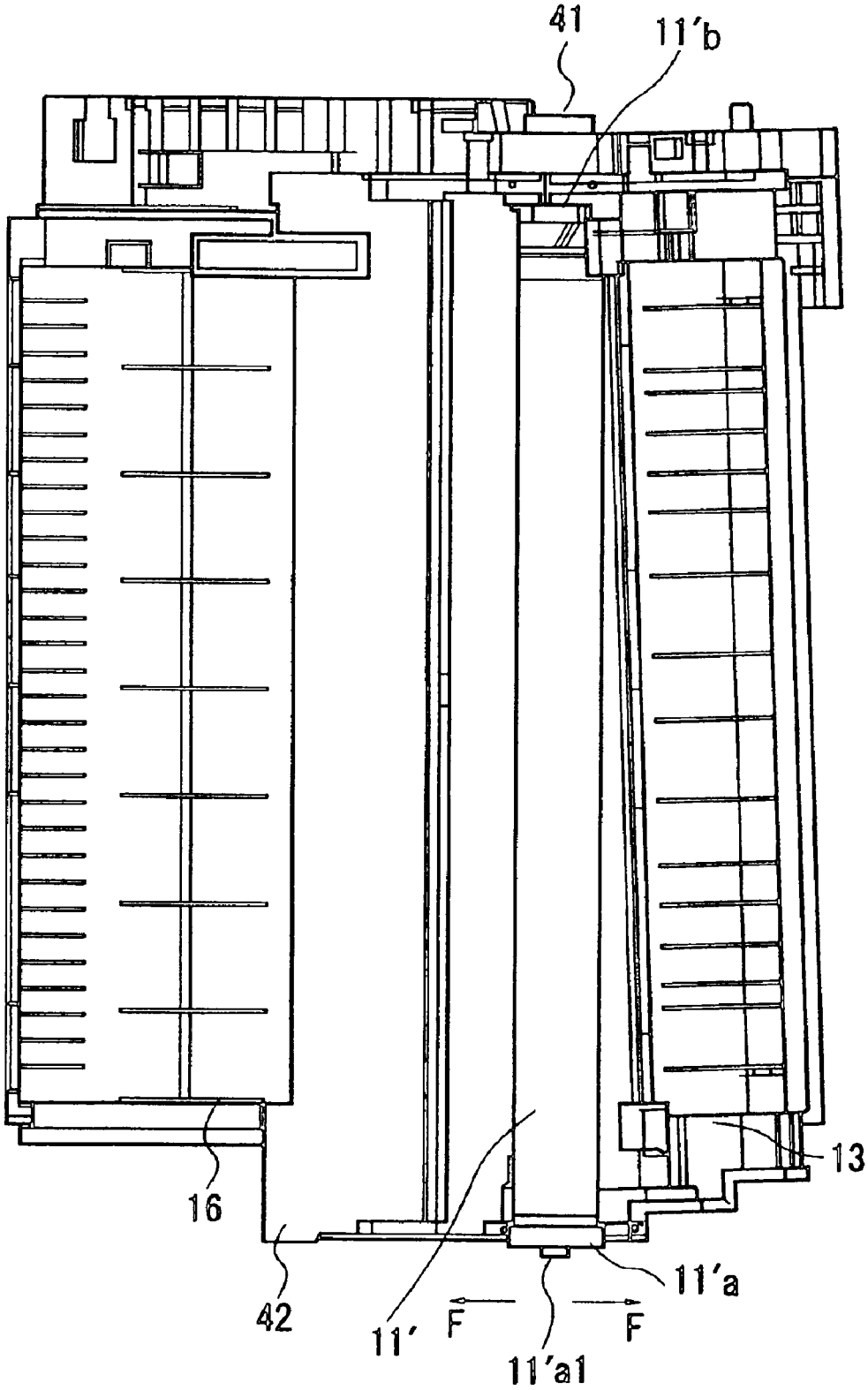
FIG. 19 is a plan view of the process cartridge, as seen from below during its assembly.
Figure 20:
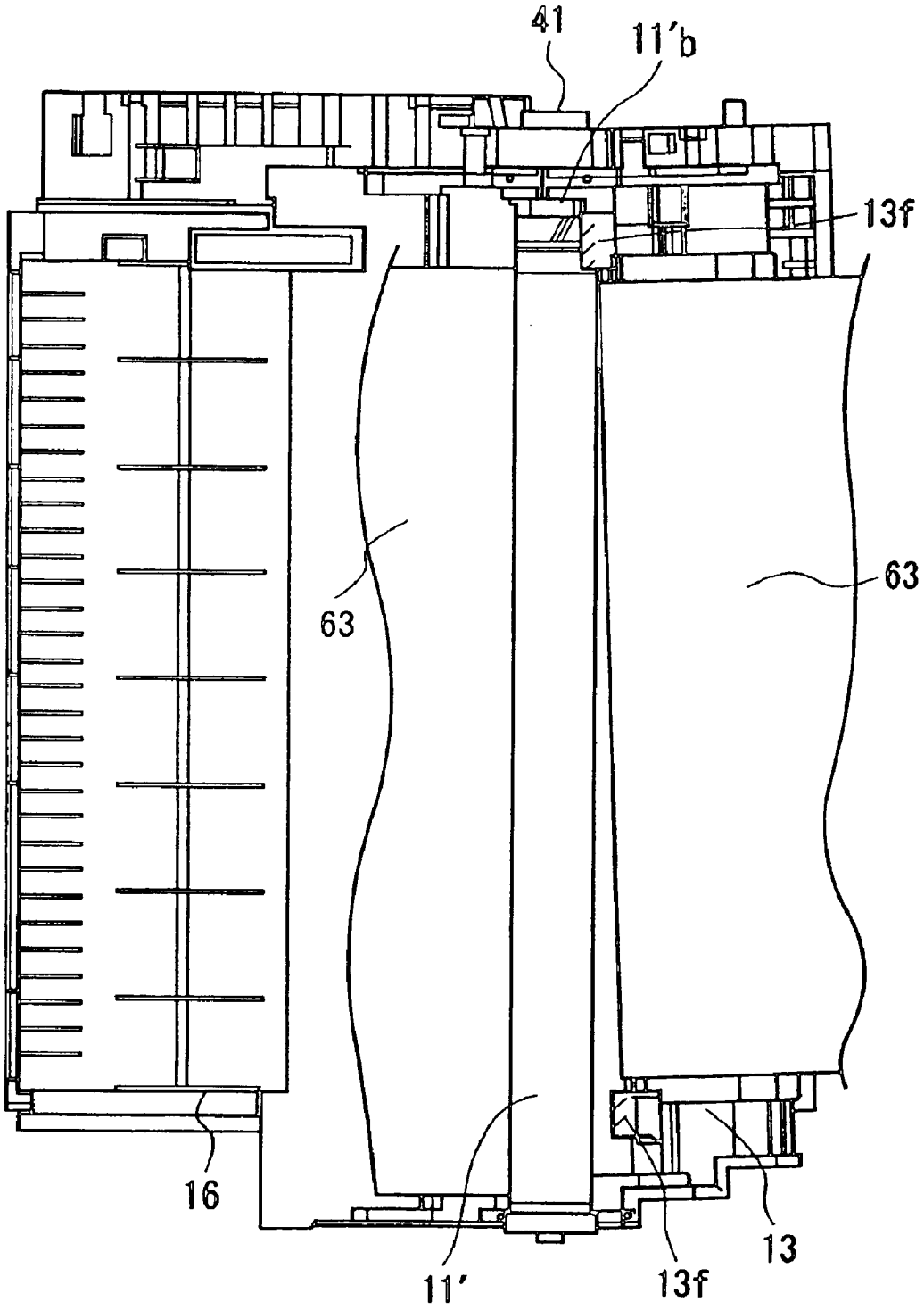
FIG. 20 is a bottom view of the process cartridge in which a drum is assembled with a sheet-like member.

Next, the insertion of the drum will be described. When the removed photoconductive drum 11 is not damaged, being thereby recyclable, it is reused. On the other hand, when it is damaged, or had reached the end of its service life, a new one is used. Here, the insertion of the photoconductive drum 11 is described with reference to a new one. Referring to FIG. 19, the gap between the frame 13 and unit 42 is forcefully widened, and kept widened, as was when the photoconductive drum 11 was removed from the development unit 42. Then, a new photoconductive drum 11' is inserted. More specifically, the end portion of the flange 11'*b* with a gear, of the new drum 11' is inserted into the bearing 41, within the end cover 20, diagonally from above, through the gap, and then, the guiding portion 11'*al* of the flange 11'*a* is inserted sideways into the U-shaped groove 13*g*. During this procedure, the new photoconductive drum 11' is protected by a sheet 63, as shown in FIG. 20, to prevent the new photoconductive drum 11' from being damaged by the corners of the drum holding frame 30 and developing means holding frame 17. The sheet 63 may be removed thereafter. The magnet pasting portion 13*f* protruding from the end portion of the frame 13, to which a magnet 65 (FIG. 18) for capturing the scattered toner particles is pasted, may be eliminated to prevent the magnetic pasting portion 13*f* from coming into contact with the photoconductive drum 11'. The pasting portion 13*f* protrudes from the lengthwise end of the transfer opening 13*n*, in the direction perpendicular to the lengthwise direction. The elimination of the pasting portion 13*f* may be carried out as the first step in the process cartridge remanufacturing process. Then, the drum shaft 40 is attached following in reverse the steps followed to remove it (FIG. 14), rotationally attaching the photoconductive drum 11' to the frame 13.

Figure 21:
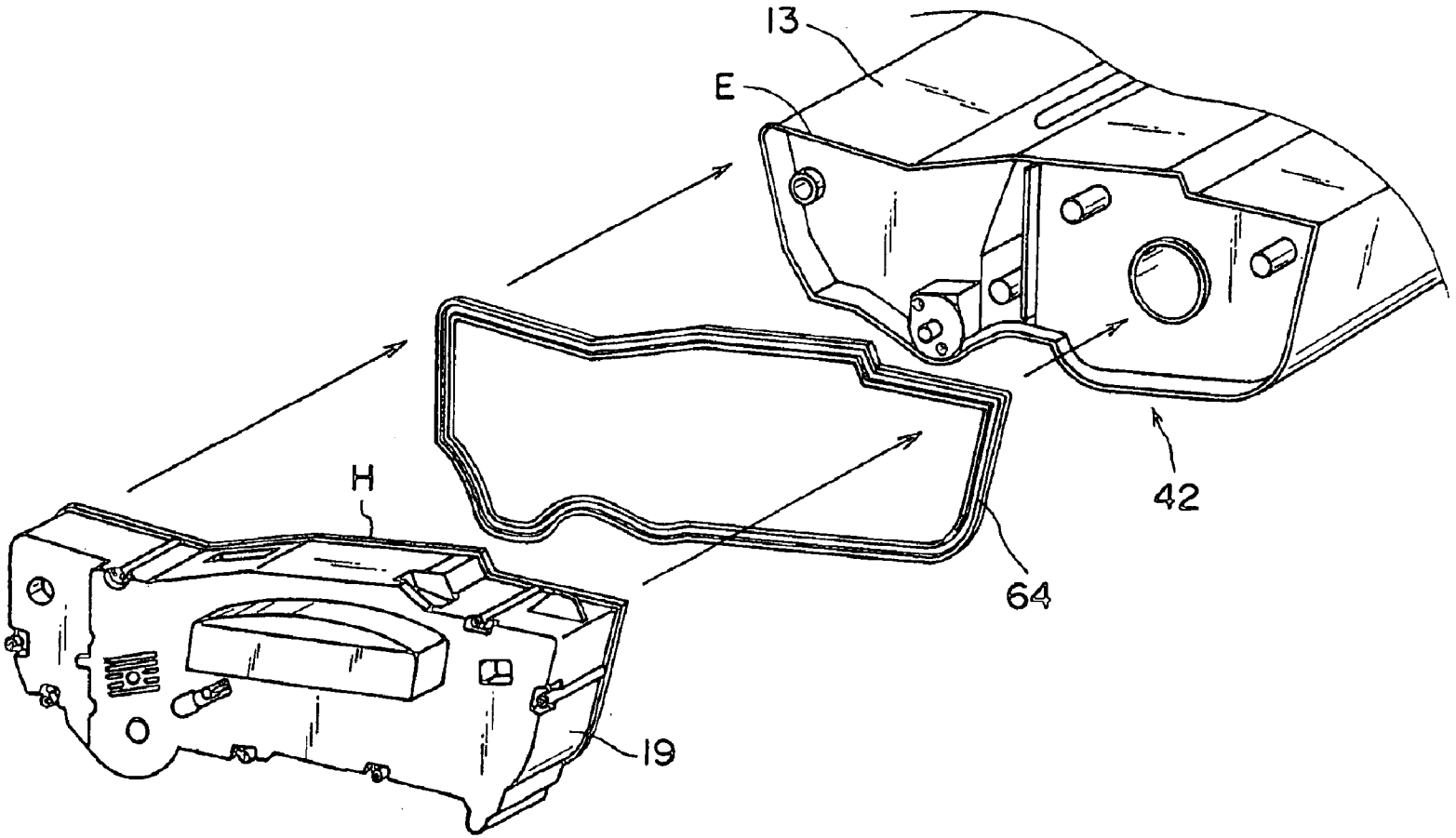
FIG. 21 is a perspective drawing for showing the method for reattaching one of the end covers.
Figure 23:
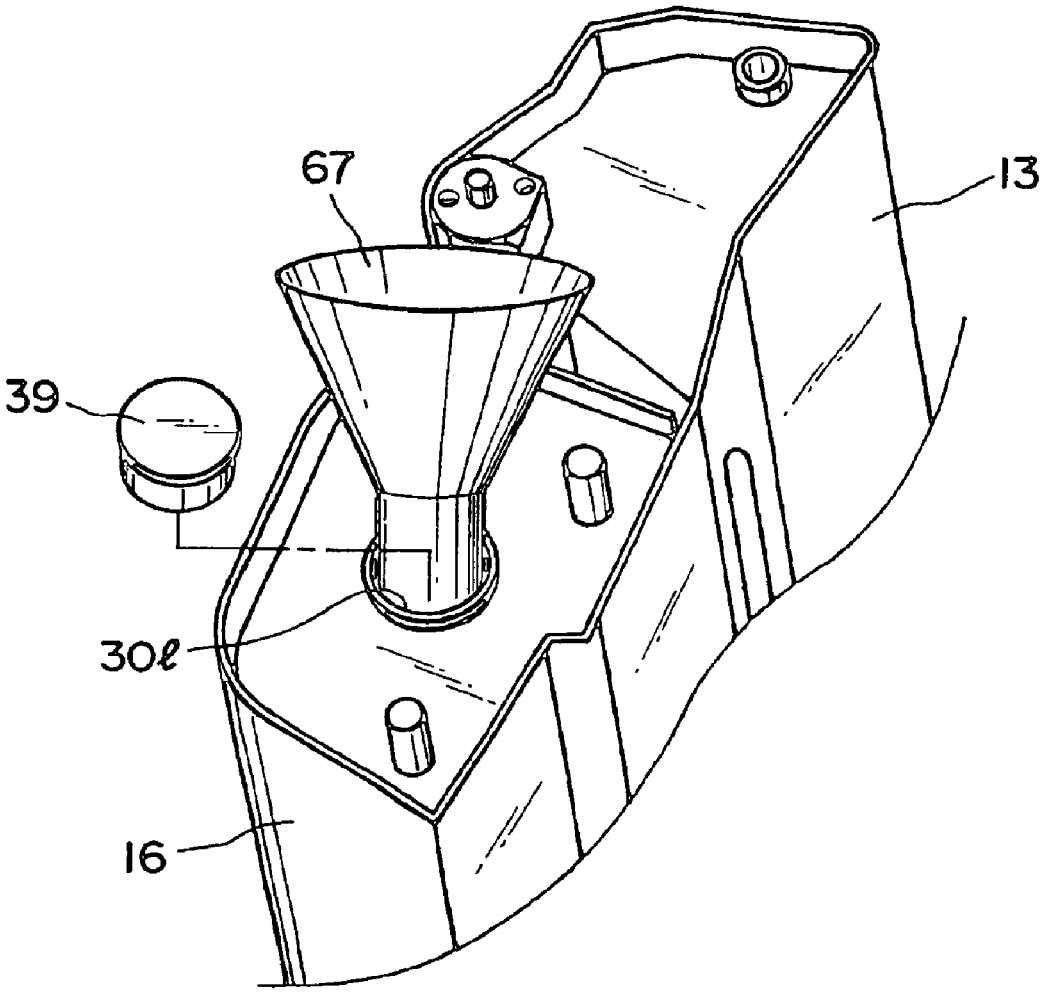
FIG. 23 is a perspective drawing for showing the method for refilling toner through the toner inlet.

Next, referring to FIG. 23, the refilling of the toner will be described. First, a toner cap 39 attached to the toner inlet 30*l* (el) of the unit 16 is removed. Then, a funnel 67 is inserted into the inlet 30*l* (el), and the toner is filled into the unit 16 by a necessary amount. After the refilling of the toner, the toner inlet 30*l* is recapped with the same cap 39, provided that the same toner cap 39 is reusable. When it is damaged, or has become defective for some reason, it is replaced with a new cap, which is inserted into the inlet 30*l*. If the toner adheres to the adjacencies of the toner inlet 30*l*, or the other places, it is to be removed after the refilling of the unit 16 with the toner. Next, the end cover 19 is attached to the combination of the frame 13 and unit 42 in the direction indicated by an arrow mark in FIG. 21. For the adjustment of the dimension of the end cover 19 in terms of the lengthwise direction of the cartridge P, a spacer 64 having a thickness equal to that of the portion removed by the milling cutter 60 is interposed between the end cover 19 and the combination of the frame 13 and unit 42 so that the spacer 64 fits around the outward facing edge E and inwardly facing edge H of the combination of the frame 13 and unit 42, and the end cover 19, respectively, and that the dimension of the cartridge P in terms of its lengthwise direction is adjusted. As for the methods for securing the end cover 19, there are a method in which double-side adhesive tape is pasted to both surfaces of the spacer 64, a method in which the end cover 19 and the combination of the frame 13 and development unit are held together with the use of clips which lock onto the recesses of the end cover 19 and the combination of the frame 13 and unit 42, or the like methods. After the attachment of the end cover 19, the removed shutter 9 is reattached following in reverse the steps followed to detach it.

With the employment of a remanufacturing method such as the one described above, a process cartridge, the service life of which has expired, can be reused.

Embodiment 2 of Process Cartridge Remanufacturing Method in Accordance with Present Invention Next, the second embodiment of the process cartridge overhauling method in accordance with the present invention will be described.

Referring to FIG. 22, the shafts 9*a* and 9*b* of the shutter 9 fitted in the holes 19*h* and 20*h* of the end covers 19 and 20 (end cover 19 side is unshown) are removed from the end covers 19 and 20 by being bent in the direction indicated by an arrow mark D. Then, the shutter 9 is disengaged from the cartridge P (up to this point, procedure is the same as that in Embodiment 1).

Figure 26:
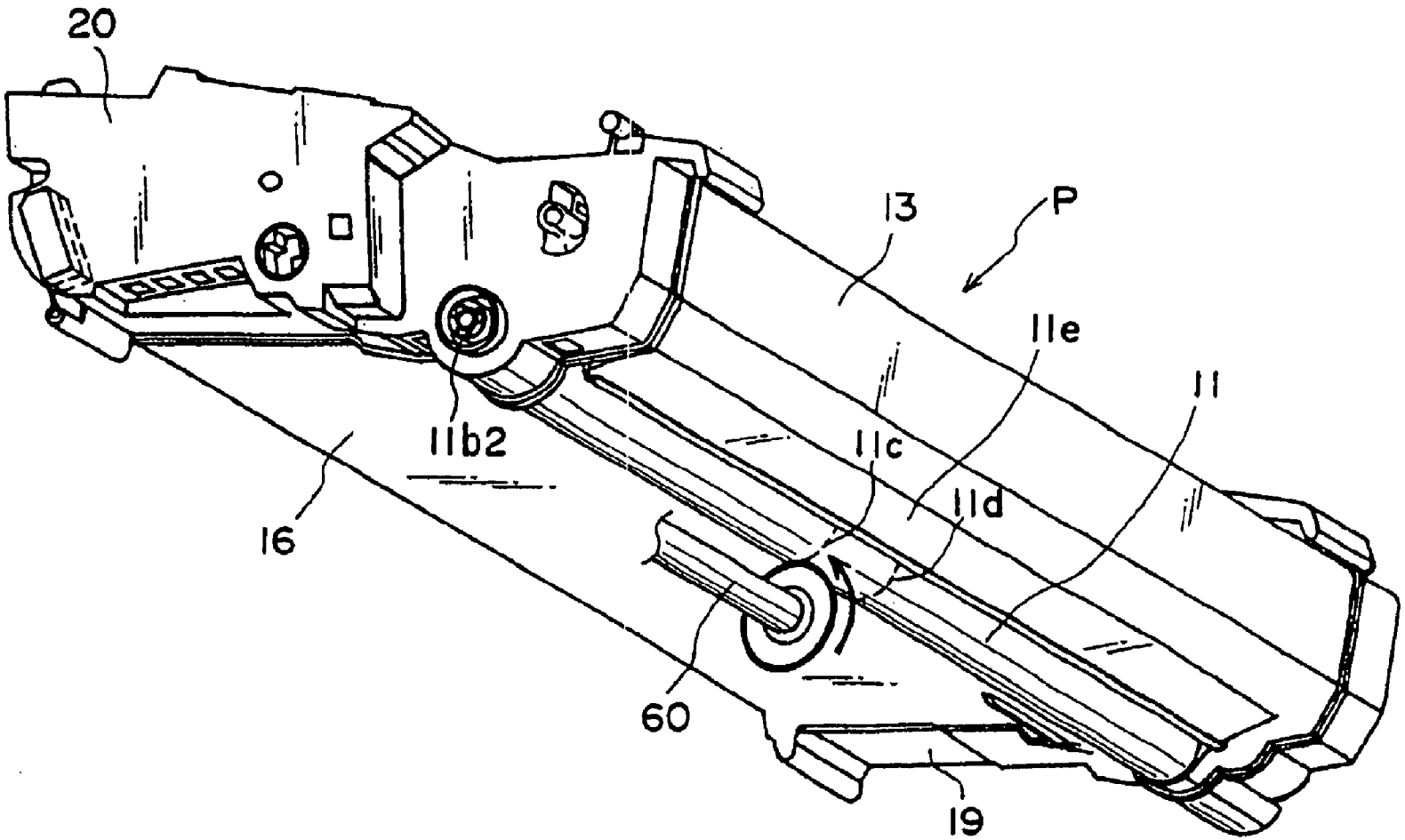
FIG. 26 is a perspective view of the process cartridge and milling cutter, as seen from diagonally below during the cutting of the process cartridge for removing the photoconductive drum.

Next, referring to FIG. 26, the cartridge P is secured to the chuck (unshown) of a milling machine. Then, a milling cutter 60 is placed in contact with the peripheral surface of the photoconductive drum 11, and the drum 11 is rotated by rotating the driving force receiving portion 11*b*2, that is, the end portion of the flange 11*b*, so that the drum 11 is cut along the dotted lines 11*c* and 11*d*. Next, the portion 11*e* of the drum 11 between the two dotted cutting lines 11*c* and 11*d* is extracted through the transfer opening 13*n*. Then, the remaining two pieces of the drum portions are extracted from the transfer opening 13*n*, in the direction indicated by an arrow mark G (diagonally upward in the drawing). More specifically, the center sides of the remaining two drum pieces are raised, tilting thereby the two drum pieces, at an angle within a range which can be afforded by the gap between the bearings 41 and flanges 11*a* and 11*b*, and within the reversible deformation range which can be afforded by the elasticity of the components around the bearings 41. Then, the two drum pieces are pulled out of the drum holding frame 13 through the transfer opening 13n.

Figure 13:
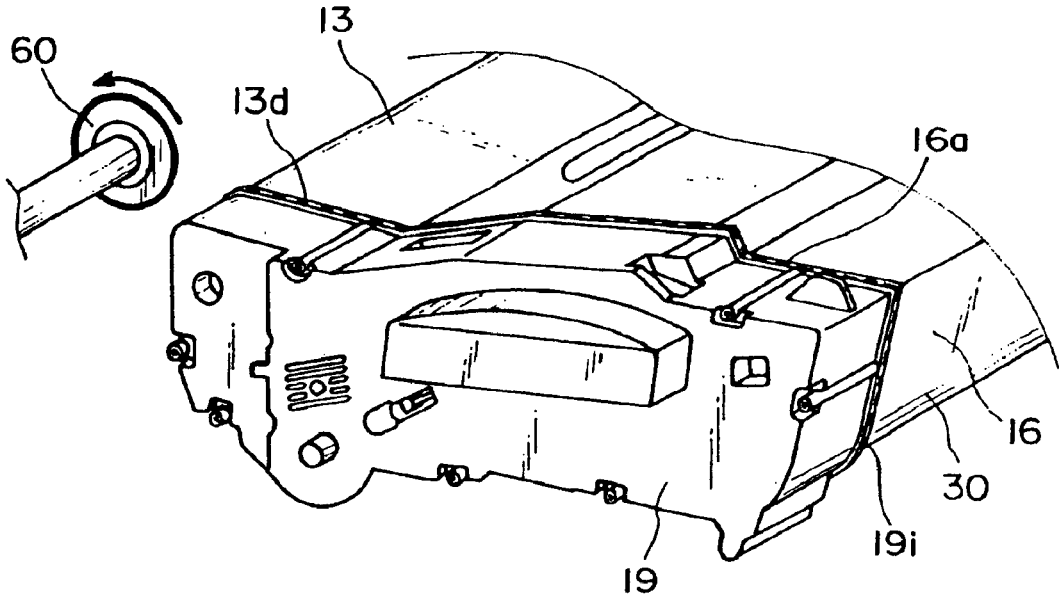
FIG. 13 is a perspective view of the end cover and corresponding lengthwise ends of the drum holding frame and developer holding frame, for showing the method for cutting off the end cover.

Next, referring to FIG. 13, the milling cutter 60 is positioned in a manner to cut into the joint 19*i* (portion indicated by dotted line in the drawing), and is moved along the inward edge of the end cover 19, cutting through the welded portions 19*i*. As a result, the end cover 19 is detached from the cartridge (cutting of the joint 19*i* is the same as that in Embodiment 1, and therefore, Embodiment 1 should be referred to for the details of the cutting of the joint 19*i* in this embodiment).

Thereafter, the small screws 61 holding the drum shaft 40 are removed as shown in FIG. 17, and the shaft 40 is removed from the frame 13.

Figure 18:
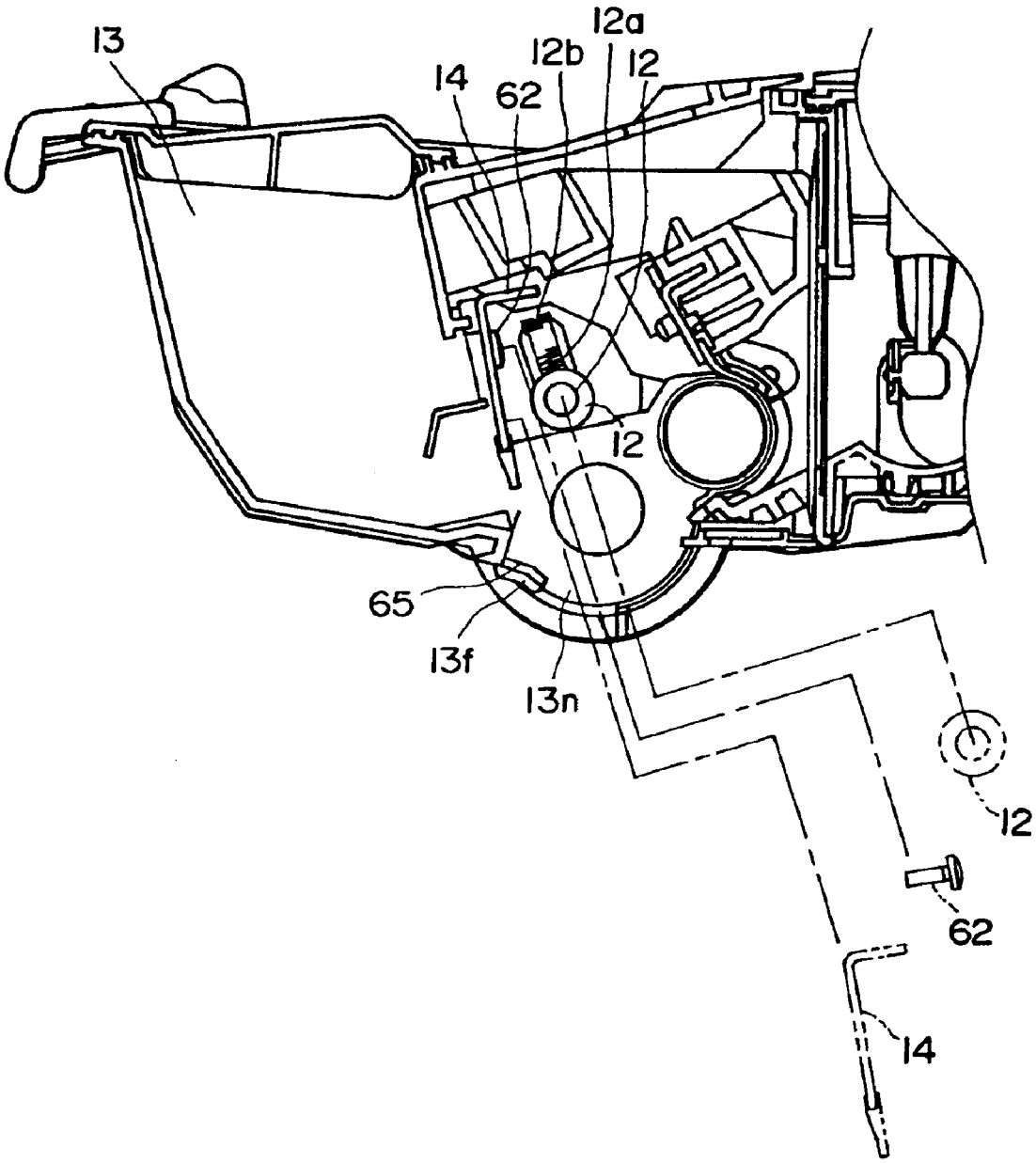
FIG. 18 is a vertical sectional view of the cleaning means holding frame.

Next, referring to FIG. 18, the cleaning blade 14 attached to the inward side of the frame 13 is examined for damages. With the presence of damages, first, charge roller 12 is removed through the transfer opening 13*n*, and the cleaning blade 14 is removed by removing the small screws 62 holding the cleaning blade 14. When the toner which was removed from the photoconductive drum 11 and collected into the drum holding frame 13 remains by a substantial amount in the drum frame 13, the toner is removed. Then, the removed blade 14 is reattached to the frame 13, with the use of the small screws 62, provided that the blade 14 was not damaged. When the removed blade 14 was damaged, a new one is attached (the same procedure as that in Embodiment 1).

Figure 25:
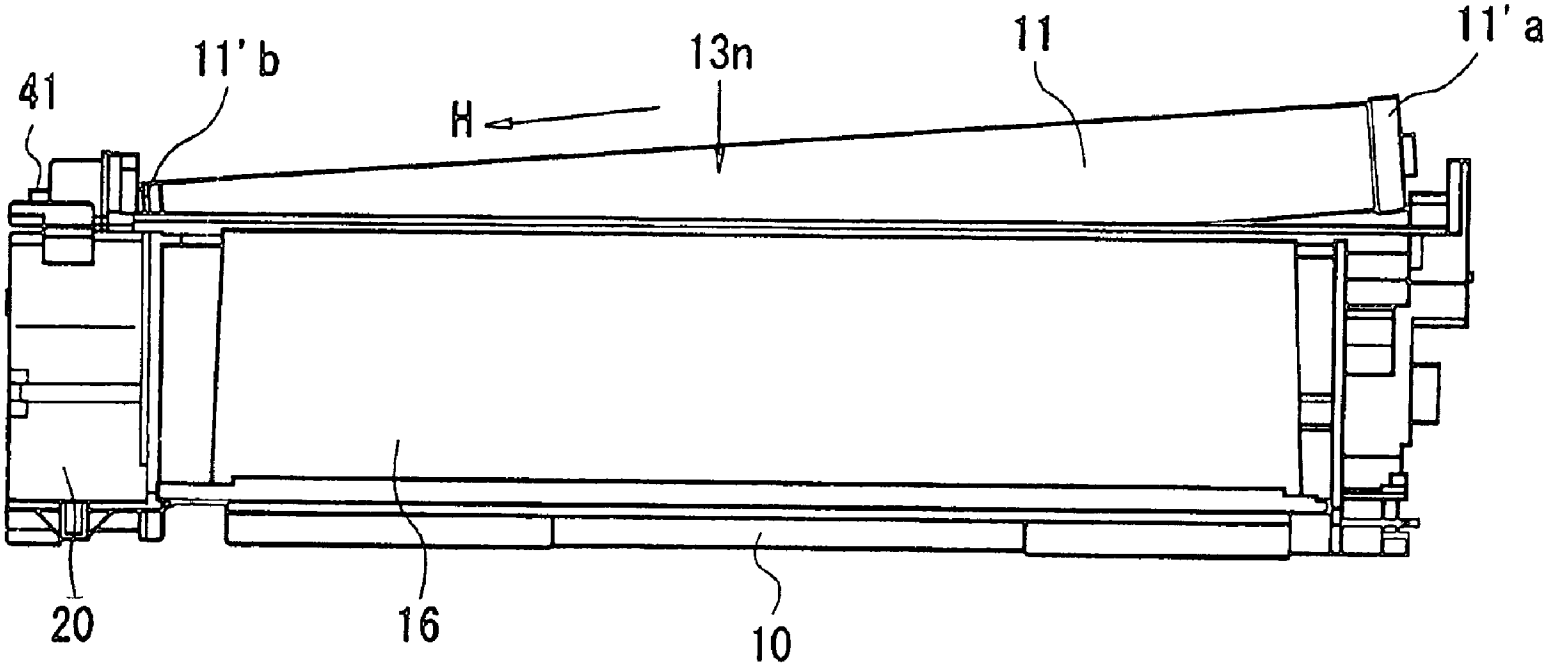
FIG. 25 is a plan view of the process cartridge in the second embodiment, as seen from the developer holding frame side during one of the assembly steps of the process cartridge.

Next, the insertion of the drum will be described with reference to FIGS. 19 and 25. First, referring to FIG. 25, the end portion of the flange 11'*c* with a gear, of a new photoconductive drum 11' is inserted into the bearing 41, diagonally from above (direction indicated by an arrow mark H). Incidentally, the bearing 41 is within the end cover 20. Then, the gap between the drum frame 13 and development unit 42, on the side from which the second end cover 19 has been removed, is widened by pressing the frame 13 and unit 42 in the directions indicated by arrow marks F, as shown in FIG. 19. Then, the guiding portion 11'*al* of the flange 11'*a* is moved following the U-shaped groove 13*g* (FIG. 17) of the drum frame 13, and is inserted sideways into the U-shaped groove 13*g*. During this procedure, the new photoconductive drum 11' is protected by a sheet 63, as shown in FIG. 20, to prevent the new photoconductive drum 11' from being damaged by the corners of the drum holding frame 30 and developing means holding frame 17. The sheet 63 may be removed thereafter. Next, the magnet pasting portion 13*f* is eliminated as described before, to prevent the magnetic pasting portion 13*f* from coming into contact with the photoconductive drum 11'. Then, the drum shaft 40 is attached following the in reverse the steps followed to remove it (FIG. 14), rotationally attaching the photoconductive drum 11' to the frame 13 (the same procedure as that in Embodiment 1). Incidentally, the flange 11'*a* is at the lengthwise end of the drum 11 on the cover 19 side.

Next, referring to FIG. 23, the refilling of the toner will be described. First, a toner cap 39 attached to the toner inlet 30*l* (el) of the unit 16 is removed. Then, a funnel 67 is inserted into the inlet 30*l* (el), and the toner is filled into the unit 16 by a necessary amount. After the refilling of the toner, the toner inlet 301 is recapped with the same cap 39, provided that the same toner cap 39 is reusable. When it is damaged, or has become defective for some reason, it is replaced with a new cap, which is inserted into the inlet 30*l*. If the toner adheres to the adjacencies of the toner 30*l*, or the other places, it is to be removed after the refilling of the unit 16 with the toner. Next, the end cover 19 is attached to the combination of the frame 13 and unit 42 in the direction indicated by an arrow mark in FIG. 21. For the adjustment of the dimension of the end cover 19 in terms of the lengthwise direction of the cartridge P, a spacer 64 having a thickness equal to that of the portion removed by the blade of the milling cutter 60 is interposed between the end cover 19 and the combination of the frame 13 and unit 42 so that the spacer 64 fits around the outward facing edge E and inwardly facing edge H of the combination of the frame 13 and unit 42, and the end cover 19, respectively, and that the dimension of the process cartridge P in terms of its lengthwise direction is adjusted. As for the methods for securing the end cover 19, there are a method in which double-side adhesive tape is pasted to both surfaces of the spacer 64, a method in which the end cover 19 and the combination of the frame 13 and development unit are held together with the use of clips, or the like methods. After the attachment of the end cover 19, the removed shutter 9 is reattached following in reverse the steps followed to remove it (the same procedure as that in Embodiment 1).

The second embodiment is different from the first embodiment only in a few steps. With the employment of a remanufacturing method such as those described above, a process cartridge, the service life of which has expired, can be reused.

Figure 27:
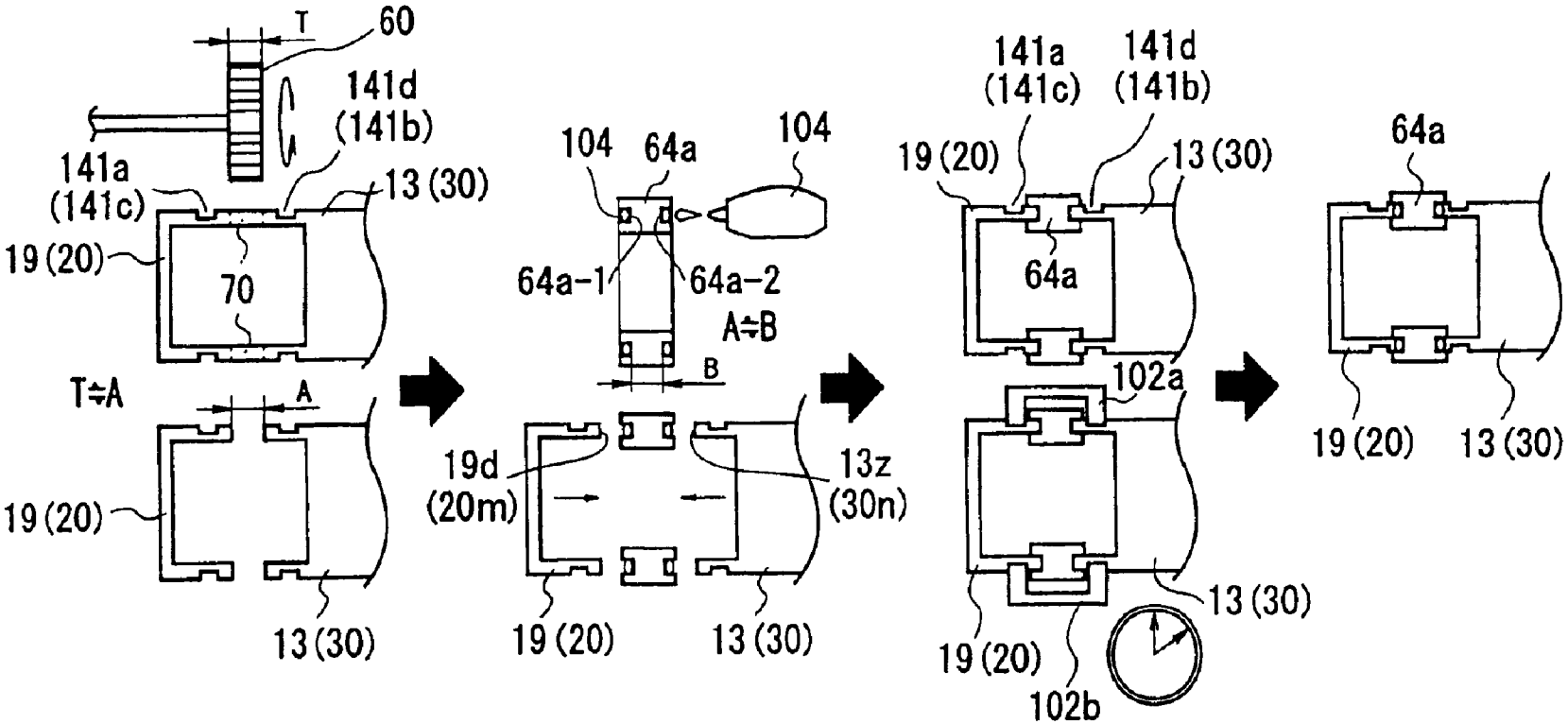
FIG. 27 is an assembly diagram for showing the method for reattaching one of the end covers, in the third embodiment of the present invention.
Figure 30:
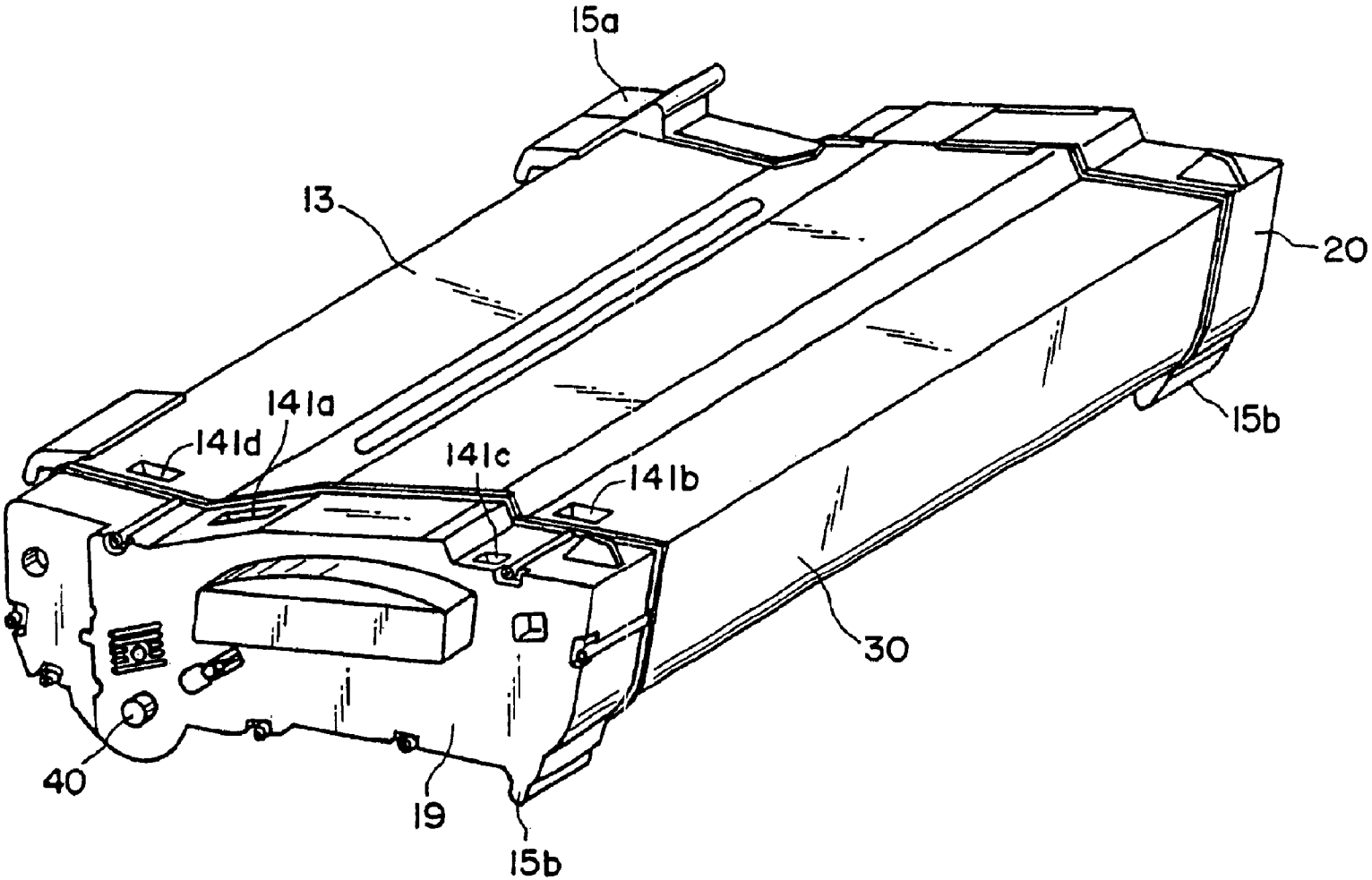
FIG. 30 is a perspective view of the process cartridge.

Embodiment 3 of Process Cartridge Remanufacturing Method in Accordance with the Present Invention The reassembling of the cartridge P, which has been disassembled as described above, will be described in detail, regarding the end covers, with reference to FIGS. 27 and 30. Here, essentially, the relationship between the end cover 19 and drum holding frame 13 will be described. The procedure for cutting off the end cover 19 is the same as that in the preceding embodiments. The procedure thereafter will be as follows.

The first step is to prepare the end cover 19, frame 13, and frame 30, which have been separated from each other.

The second step is to prepare an H-shaped spacer 64*a*, the effective thickness B of which is the same as the width A of the portion 70, in terms of the lengthwise direction of the cartridge, eliminated during the disassembly, or virtually the same as the effective thickness of the spacer 64 as a positioning member (A≈B). The width A by which the joint portion of the cartridge is eliminated during the disassembly is determined by the thickness T of the cutting edge of the tool used as a cutting means (T≈A).

Adhesive 104, hot melt, double-sided adhesive tape, or the like, is placed on the surfaces 64*a*-1 and 64*a*-2 of the spacer 64, the distance between which determines the effective thickness B of the spacer 64*a*. This process may be carried out in advance.

Figure 28:
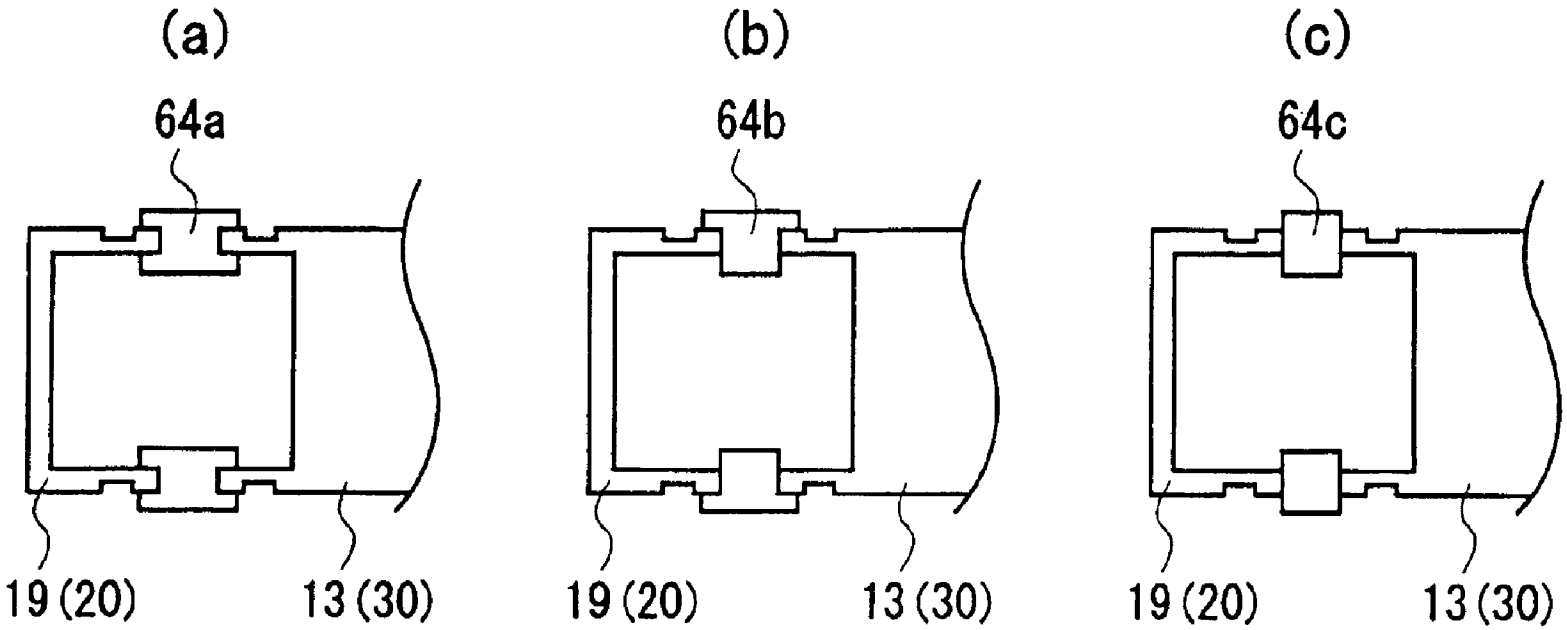
FIGS. 28(*a*), 28(*b*) and 28(*c*) are sectional views of different spacers, one for one.

The third step is to sandwich the spacer 64*a* with the end cover 19, the frame 13, the frame 30, which have been separated from each other, so that inwardly facing edge 19*d* of the end cover 19 comes into contact with the surface 64*a*-1 of the spacer 64*a*, and that the outwardly facing edge 13*z* of the frame 13 and the outwardly facing edge 30*n* of the frame 30 come into contact with the surface 64*a*-2 of the spacer 64*a*. As for the shape of the cross section of the spacer, an H-shape (64*a*) in FIG. 28(*a*), a T-shape (64*b*) in FIG. 28(*b*), and an I-shape (64*c*) in FIG. 28(*c*), are conceivable. The configuration of the spacer 64 may be such that the spacer 64 makes full contact with the entireties of the inward edges 19*d* and 20*m* of the end covers 19 and 20, respectively, created by the milling, and the entireties of the outward edges of the frame 13 and developer holding frame 30, respectively, created by the milling, or makes partial contact with them.

Figure 29:
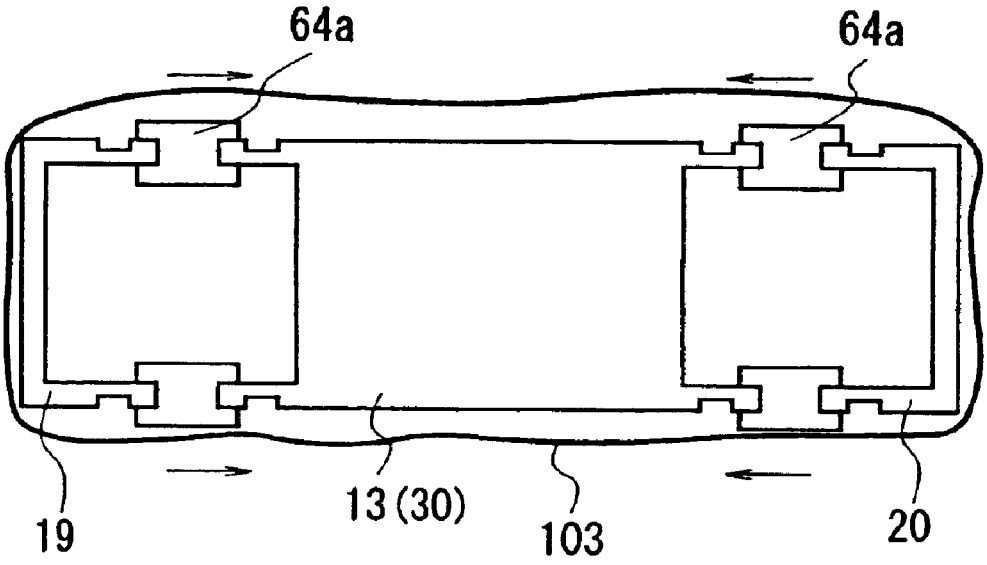
FIG. 29 is a sectional view of the spacers and their adjacencies, for showing how the spacers are held.

In the fourth step, jigs 102*a* and 102*b* are attached to the end cover 19, frame 13, and frame 30. More specifically, one end of one of the jigs 102*a* is inserted in the recess 141*a* (FIG. 30) of the end cover 19, and the other end of the same jig 102*a* is inserted in the recess 141*d* of the frame 13, whereas one end of the other jig 102*b* is inserted in the recess 141*c* of the end cover 19, and the other end of the same jig 102*b* is inserted in the recess 141*b* of the frame 30. After the insertion, the jigs 102*a* and 102*b* are held therein until the adhesive or the like between the joining surfaces dries or solidifies. Referring to FIG. 29, instead of the jigs 102*a* and 102*b*, an elastic member 103 may be used to keep the end covers 19 and 20 pressed against the drum holding frame 13 and frame 30 placed between the two end covers 19 and 20, until the adhesive or the like between the joining surfaces dries or solidifies. FIG. 29 shows the case in which the end cover 20 has also been detached from the frames 13 and 30 by cutting. In the first and second embodiments, there is no spacer on the end cover 20 side.

According to this embodiment, the cartridge can be reassembled as accurately as the original cartridge. Further, a larger number of components can be recycled, contributing to the efficient of usage of natural resources, and the environmental protection.

Those processes in the process cartridge remanufacturing methods in accordance with the present invention may be changed in order as necessary.

The above described embodiments of the present invention include a process cartridge remanufacturing method which involves simultaneously a substantial number of process cartridges with an expired service life, as well as a process cartridge remanufacturing method which involves a single process cartridge with an expired service life. In the case of the former, a substantial number of expired cartridges are recovered, and disassembled. Then, the components removed from the disassembled cartridges are sorted into groups of the identical components. Then, as large as possible a number of cartridges are reassembled from the groups of sorted recyclable components, and some new replacement components for the nonrecyclable old components. In the case of the latter, the expired cartridges are remanufactured one by one. In other words, each time an expired cartridge is recovered, it is disassembled, and reassembled using the same old components removed therefrom, some new replacement components for the nonrecyclable old components, or some old recyclable components removed from the other recovered cartridges.

The present invention includes any of the following cases:

(1) each expired cartridge is overhauled using only the components therein;

(2) each expired cartridge is overhauled using, in principle, the components therein, with the exception of the new replacement components, or the recyclable old components from the other expired cartridge, which replace the original components nonrecyclable due to service life expiration, damages, malfunctions, or the like;

(3) a plurality of expired cartridges are overhauled together; the components removed from the plurality of expired cartridges are sorted into groups of the identical components, and as large as possible a number of cartridges are reassembled using only the components from the groups of the original components; and (4) a plurality of expired cartridges are overhauled together; the components removed from the plurality of expired cartridges are sorted into groups of the identical components, and as large as possible a number of cartridges are reassembled using, in principle, the components from the groups of the original components, except for a certain number of new replacement components which replace the original components nonrecyclable due to service life expiration, damages, malfunctions, or the like.

The aforementioned components means the structural components disclosed in the claim portion of this specification, that is, the components which make up the above described portions of the cartridge. It also includes the smallest components or units, into which the cartridge can be disassembled.

As described above, the present invention is a realization of a simple method for remanufacturing a process cartridge.

While the invention has been described with reference to the structures disclosed herein, it is not confined to the details set forth, and this application is intended to cover such modifications or changes as may come within the purposes of the improvements or the scope of the following claims.

What is claimed is:

1. A remanufacturing method for a process cartridge detachably mountable to a main assembly of an electrophotographic image forming apparatus, wherein the process cartridge includes: a drum frame supporting an electrophotographic photosensitive drum having at one end a driving force receiving portion configured and positioned to receive a driving force for rotating the electrophotographic photosensitive drum from the main assembly of the electrophotographic image forming apparatus when the process cartridge is mounted to the main assembly of the electrophotographic image forming apparatus; a developing frame supporting a developing roller configured and positioned to develop an electrostatic latent image formed on the electrophotographic photosensitive drum; a developer frame having a developer accommodating portion configured to accommodate a developer to be used to develop the electrostatic latent image by the developing roller; a first end cover fixed to one longitudinal ends of the drum frame, the developing frame and the developer frame; and a second end cover fixed to the other longitudinal ends of the drum frame, the developing frame and the developer frame and, the second end cover including a grip configured and positioned to facilitate mounting and demounting of the process cartridge relative to the main assembly of the electrophotographic image forming apparatus, the method comprising:

(a) an end cover removing step of cutting a fixing portion between the second end cover and the drum frame and cutting a fixing portion between the second end cover and the developer frame, and removing the second end cover at the other longitudinal end of the drum frame, the other longitudinal end of the developing frame and the other longitudinal end of the developer frame;

(b) a drum shaft removing step of removing at the other end of the electrophotographic photosensitive drum, a drum shaft rotatably supporting the electrophotographic photosensitive drum at the other end of the electrophotographic photosensitive drum;

(c) a roller separating step of applying forces to the drum frame, the developing frame and the developer frame in directions crossing with a longitudinal direction of the electrophotographic photosensitive drum so as to separate the electrophotographic photosensitive drum and the developing roller from each other;

(d) a drum removing step of moving the electrophotographic photosensitive drum outwardly from the process cartridge at the other end of the electrophotographic photosensitive drum, while maintaining the forces applied to the drum frame, the developing frame and the developer frame, so that the electrophotographic photosensitive drum is inclined, and then removing the electrophotographic photosensitive drum from the drum frame;

(e) a drum mounting step of inserting into the drum frame one end of a new electrophotographic photosensitive drum having at one end a driving force receiving portion configured and positioned to receive a driving force for rotating the electrophotographic photosensitive drum from the main assembly of the electrophotographic image forming apparatus when the process cartridge is mounted to the main assembly of the electrophotographic image forming apparatus, such that the driving force receiving portion is exposed outside the drum frame, and inserting the drum shaft at the other longitudinal end of the drum frame from outside of the drum frame, thus mounting a new electrophotographic photosensitive drum to the drum frame;

(f) a developer refilling step of opening a filling port provided in the developer accommodating portion, refilling the developer and then closing the filling port; and (g) an end cover mounting step of fixedly mounting the second end cover to the other longitudinal end of the drum frame, the other longitudinal end of the developing frame and the other longitudinal end of the developer frame.

2. A process cartridge remanufacturing method according to claim 1, further comprising a shutter removing step of removing a shutter, configured and positioned to protect the electrophotographic photosensitive drum, from the first end cover and the second end cover which supports the electrophotographic photosensitive drum, prior to said end cover removing step, and a shutter mounting step of mounting the shutter after the process cartridge is remanufactured.

3. A process cartridge remanufacturing method according to claim 1 or 2, wherein in said end cover removing step, cutting of the fixing portion between the second end cover and the drum frame and cutting of a fixing portion between the second end cover and the developer frame are effected by a rotating cutter, an ultrasonic cutter, or a heated cutter.

4. A process cartridge remanufacturing method according to claim 3, wherein in said drum removing step, the electrophotographic photosensitive drum is removed from the drum frame through an image transfer opening configured and positioned to transfer a developed image formed on the electrophotographic photosensitive drum onto a recording material, the image transfer opening being disposed between the drum frame and the developing frame.

5. A process cartridge remanufacturing method according to claim 1 or 2, further comprising, between said drum removing step and said drum mounting step, a charging roller removing step of removing a charging roller configured and positioned to charge the electrophotographic photosensitive drum after the electrophotographic photosensitive drum is removed; a cleaning blade removing step of removing a cleaning blade, configured and positioned to remove the developer remaining on the electrophotographic photosensitive drum, from the drum frame by unthreading a screw, after the charging roller removing step; a cleaning blade mounting step of mounting the cleaning blade to the drum frame by the screw; and a charging roller mounting step of mounting the charging roller to the drum frame.

6. A process cartridge remanufacturing method according to claim 5 further comprising, after said cleaning blade removing step, a developer removing step of removing the developer which has been removed from the electrophotographic photosensitive drum and which is accommodated in the drum frame.

7. A process cartridge remanufacturing method according to claim 6, wherein in said developer removing step, the developer is removed from the drum frame by suction of the developer or blowing of the developer.

8. A process cartridge remanufacturing method according to claim 1 or 2, wherein in said drum mounting step, a protecting member is used at an edge of the drum frame and/or the developing frame to protect the surface of the electrophotographic photosensitive drum from damage.

9. A process cartridge remanufacturing method according to claim 1 or 2, wherein, a magnet mounting portion is provided in the drum frame at one and the other longitudinal ends of an image transfer opening, and is configured and positioned to mount a magnet for collecting the developer to protect a surface of the electrophotographic photosensitive drum from damage, and in the drum mounting step, the magnet mounting portion is removed.

10. A process cartridge remanufacturing method according to claim 1 or 2, wherein in said end cover mounting step of mounting the second end cover at other longitudinal ends of the drum frame, the developing frame and the developer frame, when a second end cover is mounted to the other longitudinal end of the drum frame and the developer frame, a member for correcting longitudinal position is fixed.

11. A process cartridge remanufacturing method according to claim 10, wherein in said second end cover mounting step, the drum frame and the developer frame are fixed to the second end cover by a double coated tape, an adhesive material or a clip.

12. A process cartridge remanufacturing method according to claim 1 or 2, wherein said remanufacturing of the process cartridge is carried out without mounting a seal to seal a developer supply opening, which is provided in the developer frame and is configured and positioned to permit the supply of the developer accommodated in the developer accommodating portion to the developing roller.

13. A process cartridge remanufacturing method according to claim 1 or 2, wherein said developer refilling step is carried out between said end cover removing step and said end cover mounting step.

14. A remanufacturing method for a process cartridge detachably mountable to a main assembly of an electrophotographic image forming apparatus, wherein the process cartridge includes: a drum fame supporting an electrophotographic photosensitive drum having at one longitudinal end a driving force receiving portion configured and positioned to receive a driving force for rotating the electrophotographic photosensitive drum from the main assembly of the electrophotographic image forming apparatus when the process cartridge is mounted to the main assembly of the electrophotographic image forming apparatus; a developing frame supporting a developing roller configured and positioned to develop an electrostatic latent image formed on the electrophotographic photosensitive drum; a developer frame having a developer accommodating portion configured and positioned to accommodate a developer to be used to develop the electrostatic latent image by the developing roller; a first end cover fixed to one longitudinal ends of the drum frame, the developing frame and the developer frame; and a second end cover fixed to the other longitudinal ends of the drum frame, the developing frame and the developer frame, the second end cover including a grip configured and positioned to facilitate mounting and demounting of the process cartridge relative to the main assembly of the electrophotographic image forming apparatus, said method comprising:

(a) an electrophotographic drum removing step of removing a part of the electrophotographic photosensitive drum therefrom and then removing the electrophotographic photosensitive drum from the drum frame;

(b) an end cover removing step of cutting a fixing portion between the second end cover and the drum frame and cutting a fixing portion between the second end cover and the developer frame, and removing the second end cover at the other longitudinal ends of the drum frame, the developing frame and the developer frame;

(c) a drum shaft removing step of removing from the drum frame a drum shaft rotatably supporting the electrophotographic photosensitive drum on the drum frame at the other longitudinal end of the electrophotographic photosensitive drum;

(d) a separating step of separating the drum frame and the developing frame from each other at the second end cover side when the electrophotographic photosensitive drum is mounted;

(e) a drum mounting step of inserting into the drum frame one end of a new electrophotographic photosensitive drum having at one end a driving force receiving portion configured and positioned to receive a driving force for rotating the electrophotographic photosensitive drum from the main assembly of the electrophotographic image forming apparatus when the process cartridge is mounted to the main assembly of the electrophotographic image forming apparatus, such that the driving force receiving portion is exposed outside the drum frame, and inserting the drum shaft into the other longitudinal end of the drum frame from outside of the drum frame, thus mounting a new electrophotographic photosensitive drum to the drum frame;

(f) a developer refilling step of opening a filling port provided in the developer accommodating portion, refilling the developer and then closing the filling port; and (g) an end cover mounting step of fixedly mounting the second end cover to the other longitudinal end of the drum frame, the other longitudinal end of the developing frame, and the other longitudinal end of and the developer frame.

15. A process cartridge remanufacturing method according to claim 14, further comprising a shutter removing step of removing a shutter, configured and positioned to protect the electrophotographic photosensitive drum, from the first end cover and a the second end cover which supports the electrophotographic photosensitive drum, prior to said end cover removing step, and a shutter mounting step of mounting the shutter after the process cartridge is remanufactured.

16. A process cartridge remanufacturing method according to claim 14 or 15, wherein in said drum removing step, a part of the electrophotographic photosensitive drum is cut by a rotating cutter or a blade cutter, and the cutout electrophotographic photosensitive drum is removed through an image transfer opening for transferring a developed image formed on the electrophotographic photosensitive drum onto a recording material, the image transfer opening being disposed between the drum frame and the developing frame.

17. A process cartridge remanufacturing method according to claim 14 or 15, wherein in said end cover removing step, fixing portions between the second end cover and the drum frame and a fixing portion between the second end cover and the developer frame are cut by a rotating cutter, an ultrasonic wave cutter or a hot blade.

18. A process cartridge remanufacturing method according to claim 14 or 15, further comprising, between said drum removing step and said drum mounting step, a charging roller removing step of removing a charging roller configured and positioned to charge the electrophotographic photosensitive drum after the electrophotographic photosensitive drum is removed; a cleaning blade removing step of removing a cleaning blade configured and positioned to remove the developer remaining on the electrophotographic photosensitive drum from the drum frame by unthreading a screw, after said charging roller removing step; a cleaning blade mounting step of mounting the cleaning blade to the drum frame by the screw; and a charging roller mounting step of mounting the charging roller to the drum frame.

19. A process cartridge remanufacturing method according to claim 18, further comprising, after said cleaning blade removing step, a developer removing step of removing the developer which has been removed from the electrophotographic photosensitive drum and which is accommodated in the drum frame.

20. A process cartridge remanufacturing method according to claim 19, wherein in said developer removing step, said developer is removed from the drum frame by suction of the developer or blowing of the developer.

21. A process cartridge remanufacturing method according to claim 14 or 15, wherein in said drum mounting step, a protecting member is used at an edge of the drum frame and/or the developing frame to protect the surface of the electrophotographic photosensitive drum from damage.

22. A process cartridge remanufacturing method according to claim 14 or 15, wherein, a magnet mounting portion is provided in the drum frame at one and the other longitudinal ends of an image transfer opening, and is configured and positioned to mount a magnet for collecting the developer to protect a surface of the electrophotographic photosensitive drum from damage, and in said drum mounting step, the magnet mounting portion is removed.

23. A process cartridge remanufacturing method according to claim 14 or 15, wherein in said end cover mounting step of mounting the second end cover at the other longitudinal ends of the drum frame, the developing frame, and the developer frame, when a second end cover is mounted to the other longitudinal ends of the drum frame and the developer frame, a member for correcting the longitudinal position of the second end cover is fixed.

24. A process cartridge remanufacturing method according to claim 23, wherein in said second end cover mounting step, the drum frame and the developer frame are fixed to the second end cover by a double coated tape, an adhesive material or a clip.

25. A process cartridge remanufacturing method according to claim 14 or 15, wherein said remanufacturing of the process cartridge is carried out without mounting a seal to seal a developer supply opening, which is provided in the developer frame, and which is configured and positioned to permit the supply of the developer accommodated in the developer accommodating portion to the developing roller.

26. A process cartridge remanufacturing method according to claim 14 or 15, wherein said developer refilling step is carried out between said end cover removing step and said end cover mounting step.

* * * * *

UNITED STATES PATENT AND TRADEMARK OFFICE

CERTIFICATE OF CORRECTION

PATENT NO. : 6,931,226 B2
DATED : August 16, 2005
INVENTOR(S) : Kazuo Chadani et al.

It is certified that error appears in the above-identified patent and that said Letters Patent is hereby corrected as shown below:

Title page,
Item [30], Foreign Application Priority Data, "2001/132705" should read -- 2001-132705 --.

Column 1,
Line 11, "removable" should read -- removably --.

Column 2,
Line 24, "forced" should read -- force --.
Line 49, "drum" should be deleted.

Column 4,
Line 11, "means" should read -- is --.
Line 31, "frame," should read -- frame 17, --.
Line 32, "a toner" should read -- and a toner --.
Line 33, "which" should read -- which are provided --.
Line 36, "shutter 19" should read -- shutter 9 --.
Line 38, "These frame and shutter" should read -- These frames and the shutter --.
Line 39, "mount or dismount," should read -- mounted or dismounted, --.
Line 45, "takes" should read -- assumes --.
Line 55, "13*n*," should read -- 13*n*, and --.

Column 5,
Line 23, "tion" should read -- tion performing --.

Column 6,
Line 3, "into" should read -- become fitted into --.
Line 15, "the a" should read -- the --.
Line 38, "17a" should read -- 17d --.
Line 66, "formed" should read -- form --; and "follows," should read -- a bellows, --.

Column 7,
Line 1, "inter position" should read -- interposition --.
Line 8, "fold," should read -- folded, --.
Line 9, "outwardly" should read -- outward --.
Lines 15 and 16, "is flowed" should read -- flows --.
Line 17, "secure" should read -- secured --; and "The, the" should read -- The --.

Column 8,
Line 5, "a" (second occurrence) should be deleted.

UNITED STATES PATENT AND TRADEMARK OFFICE

CERTIFICATE OF CORRECTION

PATENT NO. : 6,931,226 B2
DATED : August 16, 2005
INVENTOR(S) : Kazuo Chadani et al.

It is certified that error appears in the above-identified patent and that said Letters Patent is hereby corrected as shown below:

Column 8 (cont'd),
Line 8, "leaving" should be deleted.
Line 16, "the a" should read -- the --.
Line 38, "jointed" should read -- are jointed --.
Line 53, "15b" should read -- or fulcrums 15b --.
Line 60, "transfers" should read -- transfer --.

Column 10,
Line 24, "to" should read -- at --.
Line 31, "shaft" should read -- shafts --.
Line 35, "50 µm" should read -- a 50 µm --.
Line 36, "of" should read -- of an --.

Column 11,
Line 45, "Then," should read -- Then, as shown in Figure 13, --.
Line 55, "but a" should read -- but an --.
Line 62, "show" should read -- shown --.

Column 12,
Line 1, "11*al*" should read -- 11*a1* --.
Line 48, "11'*al*" should read -- 11'*a1* --.

Figure 24:
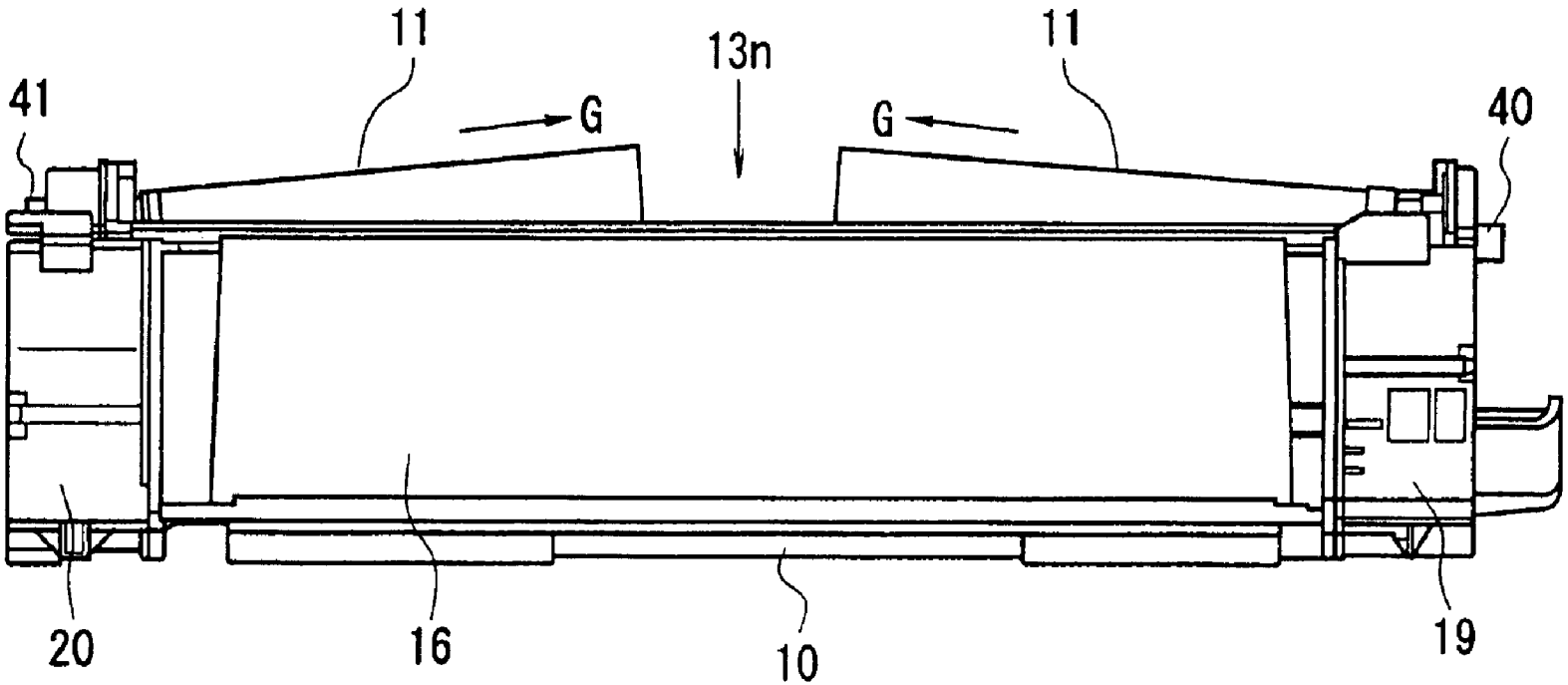
FIG. 24 is a plan view of the process cartridge in the second embodiment, as seen from the developer holding frame side during one of the disassembly steps of the process cartridge.

Column 13,
Line 49, "point," should read -- point, the --.
Line 63, "mark G" should read -- mark G in Figure 24 --.

Column 14,
Lines 6, 10 and 12, "joint" should read -- welded portion --.
Line 14, "screws 61" should read -- screws 61 (Figure 14) --.
Line 18, "damages." should read -- damage. --.
Line 19, "damages," should read -- damage, --.
Line 33, "11'*c*" should read -- 11'*b* --.
Line 41, "11'*al*" should read -- 11'*a1* --.
Line 53, "the in" should read -- in --.

Column 15,
Lines 41 and 42, "frame" should read -- the frame --.
Line 63, "13*z*" should read -- 13i --.

Column 16,
Line 30, "of usage" should read -- usage --.
Line 47, "for" should read -- are provided for --.

UNITED STATES PATENT AND TRADEMARK OFFICE

CERTIFICATE OF CORRECTION

PATENT NO. : 6,931,226 B2
DATED : August 16, 2005
INVENTOR(S) : Kazuo Chadani et al.

It is certified that error appears in the above-identified patent and that said Letters Patent is hereby corrected as shown below:

Column 17,
Line 11, "components" should read -- components that are --.
Line 13, "means" should read -- are --.

Column 19,
Line 3, "the" should read -- said --.
Line 28, "the" (first occurrence) should read -- said --.

Column 20,
Line 59, "a the" should read -- the --.

Signed and Sealed this

Eleventh Day of April, 2006

JON W. DUDAS
*Director of the United States Patent and Trademark Office*